US010634445B1

(12) United States Patent
Klett

(10) Patent No.: US 10,634,445 B1
(45) Date of Patent: Apr. 28, 2020

(54) SUPPRESSOR FOR A FIREARM

(71) Applicant: UT-Battelle, LLC, Oak Ridge, TN (US)

(72) Inventor: James W. Klett, Knoxville, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 0 days.

(21) Appl. No.: 16/438,964

(22) Filed: Jun. 12, 2019

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/28; F41A 21/36
See application file for complete search history.

(56) References Cited

U.S. PATENT DOCUMENTS

| | | | | |
|---|---|---|---|---|
| 8,516,941 | B1 | 8/2013 | Oliver | |
| 8,671,818 | B1 | 3/2014 | Oliver | |
| 8,844,422 | B1 | 9/2014 | Klett | |
| 8,875,612 | B1 | 11/2014 | Klett et al. | |
| 9,316,456 | B1 | 4/2016 | Oliver | |
| 10,126,084 | B1 | 11/2018 | Oglesby | |
| 2017/0102201 | A1* | 4/2017 | Bush | F41A 21/30 |
| 2017/0321985 | A1* | 11/2017 | Bray | F41A 21/34 |
| 2018/0209757 | A1* | 7/2018 | Hibbitts | F41A 21/30 |
| 2018/0252489 | A1* | 9/2018 | Parker | F41A 21/30 |
| 2019/0271520 | A1* | 9/2019 | Roberts | F41A 13/12 |

* cited by examiner

*Primary Examiner* — J. Woodrow Eldred
(74) *Attorney, Agent, or Firm* — Scully Scott Murphy & Presser

(57) ABSTRACT

Disclosed are several examples of suppressors for not only suppressing the blast and flash produced as a projectile is expelled from a firearm, but also reduces backpressure and heat absorbed by the suppressors during each shot.

33 Claims, 42 Drawing Sheets

Acoustic Table Simulated Results
1000

| | Diameter of vent [in] | CFD Simulated Max Pressure @ 90 deg [Pa] | CFD Simulated Max Pressure @ 170 deg [Pa] |
|---|---|---|---|
| Suppressor Designed in Accordance with Figs. 17-29 DiaA | 0.055 | 116.45 | 40.04 |
| Suppressor Designed in Accordance with Figs. 17-29 DiaB | 0.050 | 116.63 | 41.54 |
| Suppressor Designed in Accordance with Figs. 17-29 DiaC | 0.045 | 128.49 | 44.68 |

Fig. 41

SUPPRESSOR FOR A FIREARM

GOVERNMENT SUPPORT

This invention was made with government support under Prime Contract No. DE-AC05-00OR22725 awarded by the U.S. Department of Energy. The government has certain rights in the invention.

FIELD OF THE DISCLOSURE

The present disclosure relates to firearms and more specifically to suppressors that reduce the audible blast and visual flash that results from a projectile being fired from a firearm and heat absorbed by the suppressors as well as backpressure of the suppressors.

BACKGROUND

Firearms such as rifles, shotguns, pistols, and revolvers with integral or removable barrels function by discharging a projectile, such as a bullet, at a target. In each type of firearm, a cartridge or round is first loaded, manually or automatically, into a proximal chamber at a breech end of the barrel. Then, a firing pin strikes a primer located in the base of the cartridge casing, igniting an explosive propellant that produces highly pressurized gases to propel a projectile or bullet out of the cartridge casing. The bullet then travels within a central, longitudinal bore of the barrel and exits out a distal end called a muzzle.

As the bullet exits the muzzle, the highly pressurized gases quickly expand into the relatively low-pressure atmosphere, producing an audible, muzzle blast and a visual, muzzle flash. During both Military and Law Enforcement operations it is advantageous to suppress the muzzle flash from potential adversaries in order to conceal a shooter's position and gain a tactical advantage.

Firearms are known to incorporate muzzle blast suppressors and/or flash suppressors. For example, U.S. Pat. No. 8,844,422, entitled "Suppressor For Reducing The Muzzle Blast and Flash of a Firearm" discloses several examples of apparatuses for suppressing the blast and flash produced as a projectile is expelled from a firearm.

SUMMARY

Disclosed are several examples of suppressors for not only suppressing the blast and flash produced as a projectile is expelled from a firearm, but also reduces backpressure and heat absorbed by the suppressors during each shot.

In an aspect of the disclosure, the suppressors reduce the time that hot incomplete combustion gases from a firearm are present in the suppressors. This results in a reduction of the amount of heat absorbed by the suppressors.

In an aspect of the disclosure, the suppressors reduce the backpressure of the suppressors. This results in a reduction in a failure of the firearm. This also results in a reduction of an amount of gases expelled into the face of a user.

For example, disclosed is an apparatus comprising a proximal wall, a distal end wall, a cylindrical outer wall, a non-linear wall, a can, a barrier rib and a first plurality of rib. The proximal wall is on a proximal end of the apparatus. The proximal end wall has a first central opening to receive a firearm. The distal end wall is on a distal end. The distal end wall has a main exit to receive a projectile from the firearm and gases expelled by the firearm.

The cylindrical outer wall extends between the proximal end and the distal end. There is an annular gap between the proximal end wall and the cylindrical outer wall. The cylindrical outer wall has an inner surface and an outer surface.

The non-linear wall extends from the inner surface of the cylindrical outer wall. The non-linear wall is positioned at a predetermined distance from the proximal end. The non-linear wall has a second central opening aligned with the first central opening (and the main exit). The second central opening is configured to receive the projectile from the firearm and gases expelled by the firearm. The cylindrical outer wall has a first plurality of air transfer ports adjacent to the non-linear wall and between the non-linear wall and the proximal end. Each air transfer port of the first plurality of air transfer ports is an opening in the cylindrical outer wall. The non-linear wall is configured and dimensioned to divert the gases toward the first plurality of air transfer ports.

The can is disposed around and spaced apart from the cylindrical outer wall. The can has an inner surface. The barrier rib extends annularly from the outer surface of the cylindrical outer wall to the can. The barrier rib is configured to block a portion of the gases expelled from the firearm from flowing toward the distal end as the projectile moves from the proximal end to the distal end.

The first plurality of ribs extend from the outer surface of the cylindrical outer wall to the can. The first plurality of ribs also extends between the annular gap and the barrier rib. A respective space between adjacent ribs defines respective channels for gases expelled from the firearm to flow. Each channel is in fluid communication with one of the first plurality of air transfer ports, such that gases expelled from the firearm flows into the each transfer port and each channel, respectively, as the projectile moves from the proximal end to the distal end. The first plurality of ribs extend non-linearly.

In an aspect of the disclosure, the apparatus may further comprise an inner wall and an angled projection. The inner wall extends from the proximal end wall. The inner wall has a first portion and a second portion. The first portion is configured to extend along a length of an inserted portion of a muzzle of the firearm and the second portion is configured to be a stop for the muzzle. The first portion is spaced from the inner surface of the cylindrical outer wall. The proximal end wall has a non-linear inner surface. The non-linear inner surface is configured to divert gases flows from the channels formed by the adjacent ribs and flowing though the annular gap into the space between the inner surface of the cylindrical outer wall and the first portion and the second portion of the inner wall. The angled projection extends between the second portion and the inner surface of the cylindrical outer wall. The angled projection is a barrier for gases in the space between the inner surface of the cylindrical outer wall and the first portion and the second portion, and is configured to prevent gases from flowing further toward the distal end. The angled projection is further configured to allow the gases expelled from the firearm to expand and be directed to the first plurality of air transfer ports.

In an aspect of the disclosure, the apparatus may further comprise another rib, a second plurality of ribs, a second plurality of air transfer ports and another non-linear wall. The another rib extends annularly from the outer surface of the cylindrical outer wall to the can. The another rib is a predetermined distance from the distal end. The second plurality of ribs extend from the outer surface of the cylindrical outer wall to the can. The second plurality of ribs also extend between the barrier rib and the another rib. A respective space between adjacent ribs of the second plurality of ribs defines respective channels for gases expelled from the firearm to flow.

The another non-linear wall extends from the inner surface of the cylindrical outer wall. The another non-linear wall has a corresponding central opening to the second central opening and aligned therewith. The another non-linear wall is positioned between the second plurality of air transfer ports and the distal end. The non-linear wall and the another non-linear wall sandwich the second plurality of air transfer ports. The another non-linear wall is configured and dimensioned to divert the gases toward the second plurality of air transfer ports.

In an aspect of the disclosure, a subset of channels formed by the adjacent ribs of the second plurality of ribs are respectively aligned with a corresponding one of the second plurality of air transfer ports, respectively, such that gases expelled from the firearm as the projectile moves from the proximal end to the distal end flow into the second plurality of air transfer ports and the subset of channels, respectively.

In an aspect of the disclosure, the distal end wall has a diameter equal to a diameter of the can such that there is a space between the another rib and the distal end wall in a longitudinal directional. The space also extends between the outer surface of the cylindrical outer wall and the inner surface of the can.

In an aspect of the disclosure, the another rib has a plurality of vents. These vents are configured for flow of gases. For example, the vents allow gases flowing in the subset of channels formed by the adjacent ribs of the second plurality of ribs to enter the space defined between the another rib and the distal end wall in the longitudinal directional and extending between the outer surface of the cylindrical outer wall and the inner surface of the can. The vents is also allow gases within the space between the another rib and the distal end wall in the longitudinal directional and extending between the outer surface of the cylindrical outer wall and the inner surface of the can to enter other channels formed by the adjacent ribs of the second plurality of ribs.

In an aspect of the disclosure, the distal end wall also has a plurality of vents. These vents are configured to allow gases within the space defined between the another rib and the distal end wall in the longitudinal directional and extending between the outer surface of the cylindrical outer wall and the inner surface of the can to escape the apparatus. The timing that gases escape the apparatus from the plurality of vents in at least the distal end wall is controllable to cause destructive interference with a sound generated by gases escaping the apparatus from the main exit, e.g., acoustic wave shaping. The size of the vents affect the timing and the size may be optimize via CFD design as needed for performance.

In an aspect of the disclosure, the pattern and pitches of the first plurality of ribs and the second plurality of rib may be set to control the timing of the gases escaping the vents and the same may be optimized via CFD design as needed for performance.

In an aspect of the disclosure, the apparatus further comprises a plurality of baffles. The baffles are disposed between the another non-linear wall and the distal end wall. Each baffle has a third central opening, which is aligned with the first central opening, the second central opening and the main exit. Each baffle is configured to divert gases expelled by the firearm as the projectile moves from the proximal end to the distal end toward the inner surface of the cylindrical outer wall. The baffle closest to the distal end wall has at least one slit configured to allow gases to flow into a pocket.

In an aspect of the disclosure, the gases which escape the apparatus via the plurality of vents in the distal end wall generate a slip stream. The slip stream restricts a generation of a mushroom of gases created by the gases escaping the apparatus from the main exit.

In an aspect of the disclosure, the gases that are diverted into the plurality of channels throughout the apparatus, into the space, toward the inner surface of the cylindrical outer wall and into the pocket, change a speed that gases escaping the apparatus from the main exit travels from a speed in which the gases enter the apparatus.

In other aspects of the disclosure the apparatus comprises a proximal end wall, a distal end wall, an outer wall with first through third portions, a non-linear wall, a can, a segmented barrier rib having a plurality of segments and a first plurality of ribs.

The proximal end wall is on a proximal end. The proximal end wall has a first central opening configured to receive a firearm. The distal end wall has a main exit at least partial aligned with the first central opening. The main exit receives a projectile from the firearm and gases expelled by the firearm.

The outer wall extends between the proximal end and the distal. The first portion extends from an inner surface of the proximal end wall to a first preset position in a longitudinal direction. The second portion extends between a second preset position and the distal end in the longitudinal direction. The third portion connects the first portion and the second portion.

The non-linear wall extends from an inner surface of the second portion of the outer wall. The non-linear wall has a second central opening aligned with the first central opening. The second central opening is configured to receive a projectile from the firearm and gases expelled by the firearm.

The can is disposed around and spaced apart from the outer wall. The can has an inner surface. A distance between the inner surface of the can and an outer surface of the second portion is smaller than a distance between the inner surface of the can and an outer surface of the first portion.

The segmented barrier rib extends from the outer surface of the second portion of the outer wall to the can. Each segment extends in a circumferential direction. There is a gap between adjacent segments in the circumferential direction. The first plurality of ribs extend between the outer surface of the first portion and the inner surface of the can and also extend between the outer surface of the third portion and the inner surface of the can and extend from the segmented barrier rib toward the proximal end. Each segment has a first end and a second end in the circumferential direction. One of the first plurality of ribs extends from the first end and another of the first plurality of ribs extends from the second end. There is a gap between the first plurality of ribs and the proximal end wall. The first plurality of ribs extend non-linearly.

The third portion has a plurality of air transfer ports. Each air transfer port extends between the first portion and the second portion. The third portion extends between adjacent air transfer ports. An air transfer port corresponds to a segment such that the air transfer port is between the one of the first plurality of ribs which extends from the first end and the another of the first plurality of ribs which extends from the second end of the same segment. A respective space between the one of the first plurality of ribs which extends from the first end and the another of the first plurality of ribs which extends from the second end of the same segment defines respective channels for gases expelled from the firearm to flow. Each channel is in fluid communication with one of the plurality of air transfer ports, such that gases expelled from the firearm flows into the each transfer port and each channel, respectively.

The non-linear wall is configured and dimensioned to divert the gases toward the plurality of air transfer ports. Each segment is configured to block a portion of gases expelled from the firearm from flowing toward the distal end as the projectile moves from the proximal end to the distal end.

The inner surface of the proximal end wall is non-linear. The non-linear inner surface is configured to divert gases flowing from the channels and into the gap between the first plurality of ribs and the proximal end wall into other channels such that gases expelled from the firearm flow toward the distal end. Each of the other channels is defined by one of the plurality of ribs which extends from a first end of a segment and another of the plurality of ribs which extends from a second end of an adjacent segment.

The distal end wall has a diameter equal to a diameter of the can such that there is a space between the rib and the distal end wall in the longitudinal directional. The space also extends between the outer surface of the second portion and the inner surface of the can.

In other aspects of the disclosure, the apparatus may also comprises a rib extending annularly from the outer surface of the second portion to the can and a second plurality of ribs extending from the outer surface of the second portion wall to the can. The rib is a predetermined distance from the distal end. The second plurality of ribs extend from the rib toward the proximal end. A respective space is between adjacent ribs of the second plurality of ribs and defines respective channels for gases expelled from the firearm to flow. The second plurality of ribs extend non-linearly. The other channels are in fluid communication with the channels defined by the adjacent ribs of the second plurality of ribs.

In other aspects of the disclosure, the second plurality of ribs may extend to a respective segment.

In other aspects of the disclosure, the number of the second plurality of ribs may be less than a number of the first plurality of ribs.

In other aspects of the disclosure, the rib has a plurality of vents configured to allow gas flowing in the channels formed by the adjacent ribs of the second plurality of ribs to enter the space.

In other aspects of the disclosure, the distal end wall has a first plurality of vents configured allow gases within the space to escape the apparatus. The timing that gases escape the apparatus from the first plurality of vents in the distal end wall is controllable to cause destructive interference with a sound generated by gases escaping the apparatus from the main exit, e.g., acoustic wave shaping. The size of the vents affect the timing and the size may be optimize via CFD design as needed for performance.

In other aspects of the disclosure, the pattern and pitches of the first plurality of ribs and the second plurality of rib may be set to control the timing of the gases escaping the vents and the same may be optimized via CFD design as needed for performance.

In other aspects of the disclosure, the apparatus may further comprise a plurality of baffles disposed between the non-linear wall and the distal end wall. Each baffle has a third central opening, which is at least partially aligned with the first central opening, the second central opening and the main exit, each baffle is configured to divert gases expelled by the firearm as the projectile moves from the proximal end to the distal end toward the inner surface of the second portion. At least the baffle closest to the distal end wall has at least one slit configured to allow gases to flow toward the distal end.

In other aspects of the disclosure, the distal end wall may have a second plurality of vents configured allow gases flowing through the slit in at least one baffle to escape the apparatus. The second plurality of vents is between the first plurality of vents and the main exit in the radial direction. The timing that gases escape the apparatus from both plurality of vents in the distal end wall is controllable to cause destructive interference with a sound generated by gases escaping the apparatus from the main exit, e.g., acoustic wave shaping. The size of the vents affect the timing and the size may be optimize via CFD design as needed for performance.

In other aspects of the disclosure, the gases which escape the apparatus via both plurality of vents in the distal end wall generate slip streams. The slip streams restrict a generation of a mushroom of gases created by the gases escaping the apparatus from the main exit.

In yet other aspects of the disclosure, the apparatus may further comprises an inner annular wall spaced apart from second portion and a third plurality of ribs extending from an outer surface of the inner annular wall to an inner surface of the second portion. The inner annular wall extends from the distal end wall toward the proximal end. The third plurality of ribs extend from the distal end wall toward the proximal end. A respective space between adjacent ribs of the third plurality of ribs defines respective channels for gases expelled from the firearm to flow. The third plurality of ribs extend non-linearly.

In yet other aspects of the disclosure, the baffles may extend from an inner surface of the inner annular wall.

In yet other aspects of the disclosure, the apparatus may further comprise another wall, which is disposed between the non-linear wall and the baffles. The another wall is configured to divert gases to flow toward the channels defined by the adjacent ribs of the third plurality of ribs.

In yet other aspects of the disclosure, the distal end wall may also having a plurality of vents configured allow gases from channels defined by the adjacent ribs of the third plurality of ribs to escape the apparatus or configured allow gases diverted by the baffles to escape the apparatus. In accordance with this aspect, gases that escape will generate a slip stream(s) and restrict the generation of a mushroom of gases created by the gases escaping the apparatus from the main exit.

BRIEF DESCRIPTION OF THE DRAWINGS

FIG. 41 is a table showing simulated acoustic results for a suppressor designed in accordance with aspects of the disclosure with different diameters for the outer vents on the distal end wall.

DETAILED DESCRIPTION

Suppressors in accordance with aspects of the disclosure will now be described in greater detail. Computer models of the suppressors were first generated using a Computer Aided Design (CAD) program before being analyzed with Computational Fluid Dynamics (CFD). The CFD results were examined and each suppressor's geometry was optimized to reduce the mach number of the gases exiting the suppressor, reducing the time that the hot incomplete combustion gases are present in the suppressors, reduce backpressure and expel the gases from vents at a controllable timing. Please note that various types of firearms are known to have different barrel lengths, use different cartridge loads, and operate at different gas pressures. For this reason, parametric manipulation of some of the claimed elements may be necessary to ensure a suppressor design is optimized for each specific application.

Figure 1A:
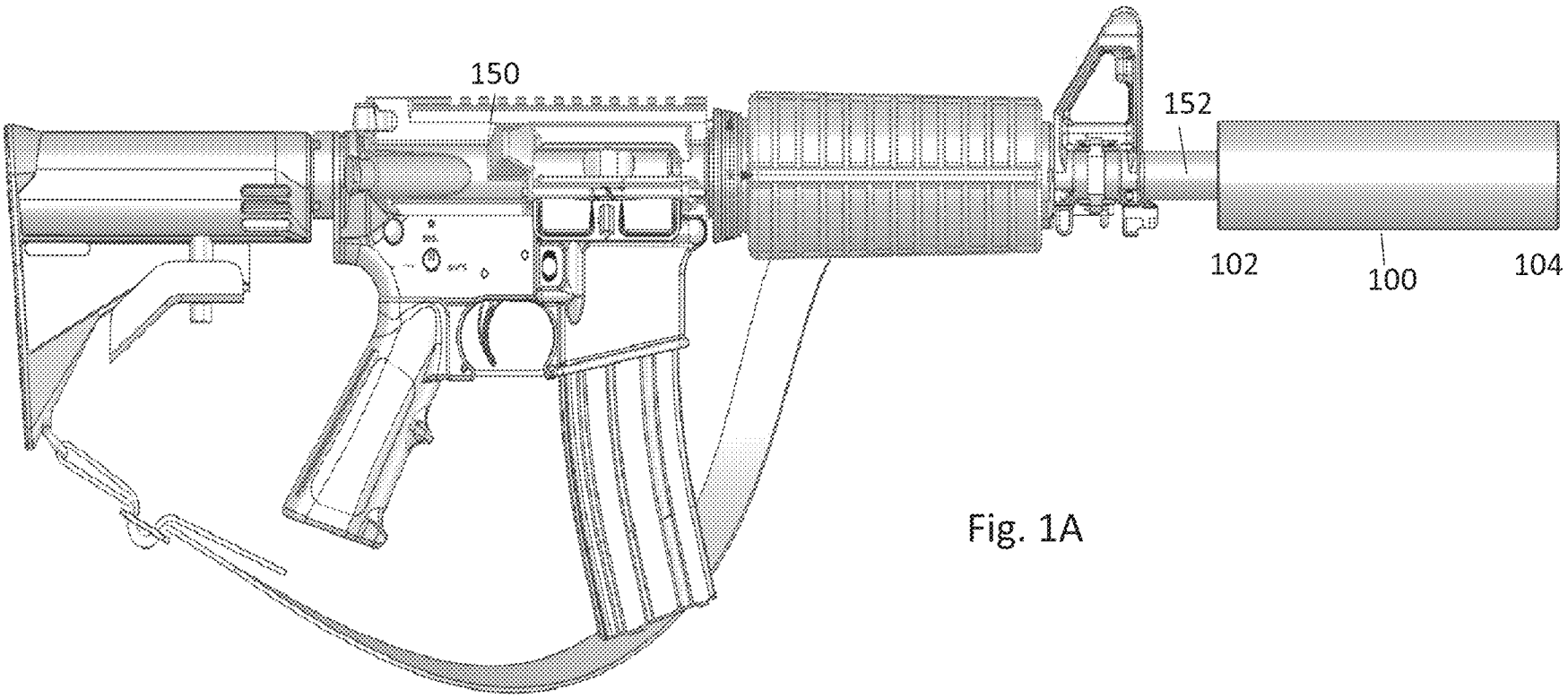
FIG. 1A is a side view of a firearm with a suppressor installed in accordance with aspects of the disclosure.
Figure 1B:
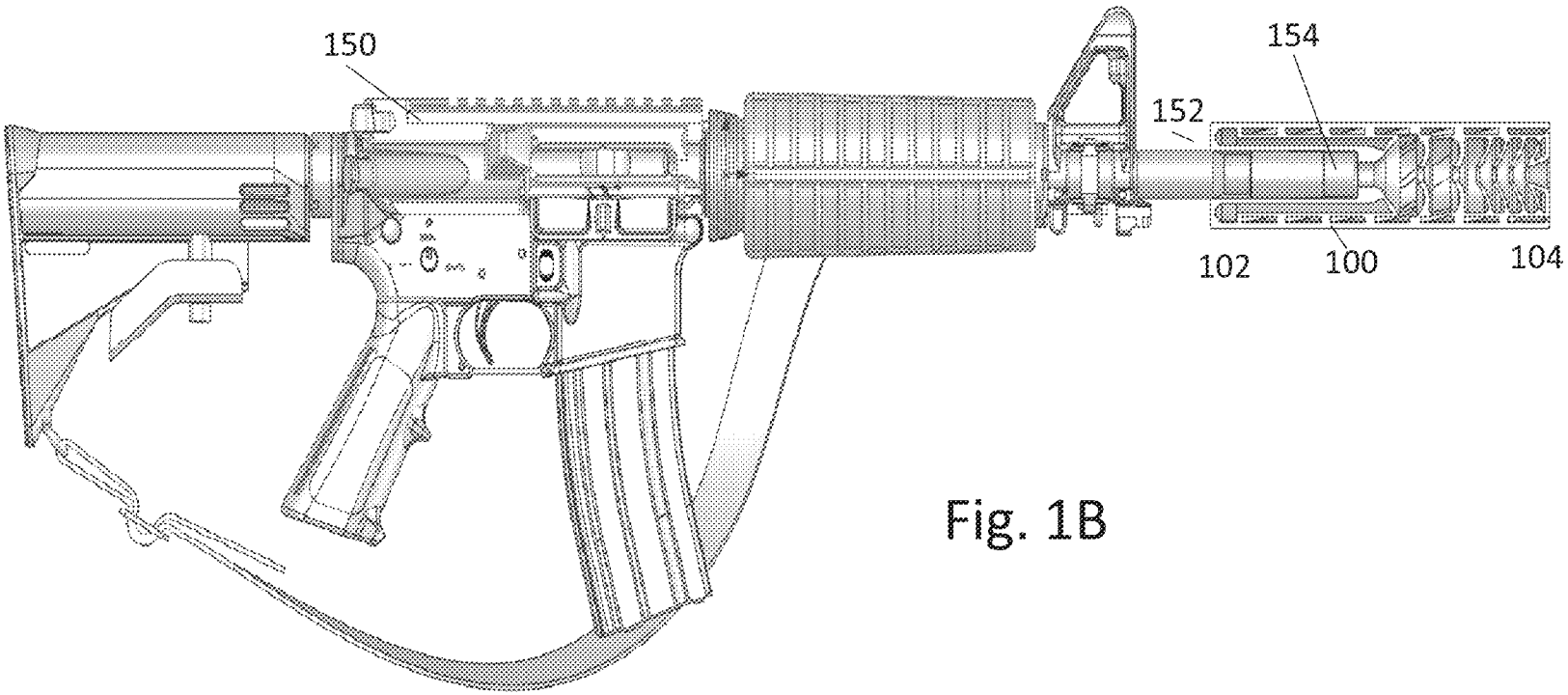
FIG. 1B is a cutaway side view of the suppressor installed on a firearm in accordance with aspects of the disclosure.

Referring to FIG. 1A and FIG. 1B, a firearm 150 includes a barrel 152 for discharging a projectile at an intended target. Affixed to a muzzle end 154 of the barrel 152 is a suppressor 100 in accordance with aspects of the disclosure. The suppressor 100 has a proximal end 102 for affixing to the firearm 150 and an opposite distal end 104 where the projectile exits the suppressor 100. The firearm 150 illustrated in FIGS. 1A and 1B is exemplary and is not to be considered exhaustive in any way. Many firearm architectures have existed in the past, currently exist today, or will exist in the future. It is to be understood that all types of firearms 150 will benefit from the exemplary suppressors 100, 100A and 100B described herein.

An example of a suppressor in accordance with aspects of the disclosure will be described in more detail with reference to FIGS. 2-16. The suppressors described herein may be manufactured by 3D printing process, such as a direct to metal (DTM) 3D printing. Other manufacturing techniques may be used such as investment casting, machining, sheet stamping and welding. Other suitable manufacturing techniques may also be used The suppressors may be made of light-weight and high-strength materials. The material may include Titanium, Aluminum, Aluminum-Cerium Alloy, Stainless Steels, Nickel and INCONEL alloy or combinations thereof. In an aspect of the disclosure, the suppressor 100 has four expansion and diversion chambers (First Chamber 60, Second Chamber 62, Third Chamber 64, Fourth Chamber 66) for gases expelled by the firearm 150.

Figure 2:
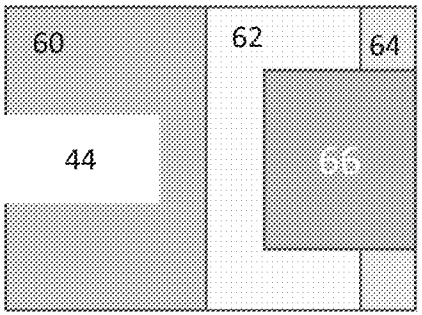
FIG. 2 is a drawing of the suppressor of FIG. 1B in accordance with aspects of the disclosure showing relative locations of gas expansion chambers.

FIG. 2 shows the relative location of the chambers 60, 62, 64 and 66 in the suppressor 100. The first chamber 60 is located between the proximal end 102 and a barrier rib 14 (which will be described later in detail). The second chamber 62 is located between the barrier rib 14 and annular rib 16 (which will be described later in detail). The third chamber 64 is located between the annular rib 16 and the distal end 104. The fourth chamber 66 is located between the non-linear wall 53 (which will be described later in detail) and the distal end 104. "Located between" herein refers to a longitudinal direction. The fourth chamber 66 is radially inward of the third chamber 64.

Figure 3:
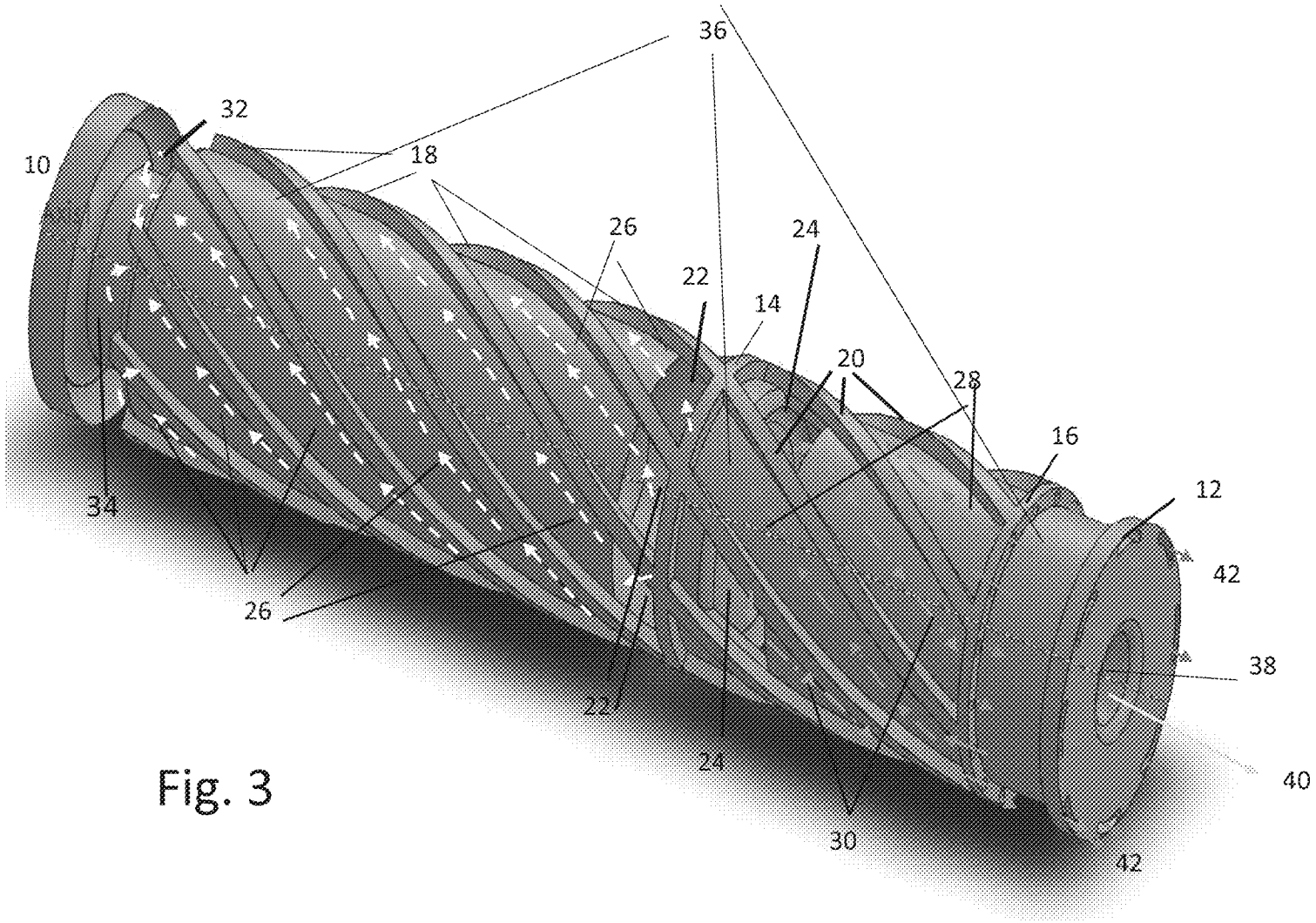
FIG. 3 is a perspective view of the suppressor without a can in accordance with aspects of the disclosure.
Figure 10:
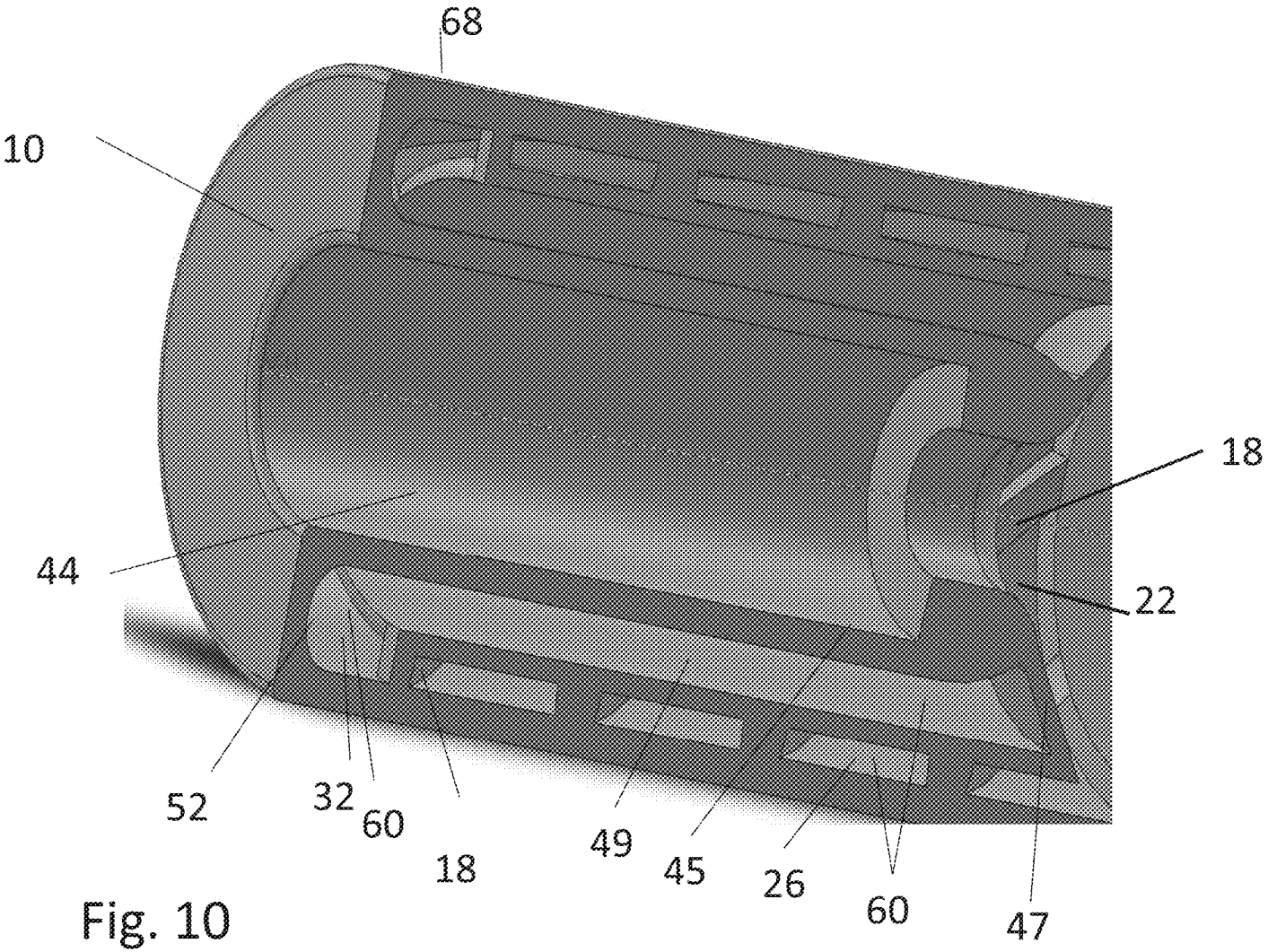
FIG. 10 is a cutaway view of part of the first chamber of the suppressor of FIG. 3 in accordance with aspects of the disclosure.
Figure 11:
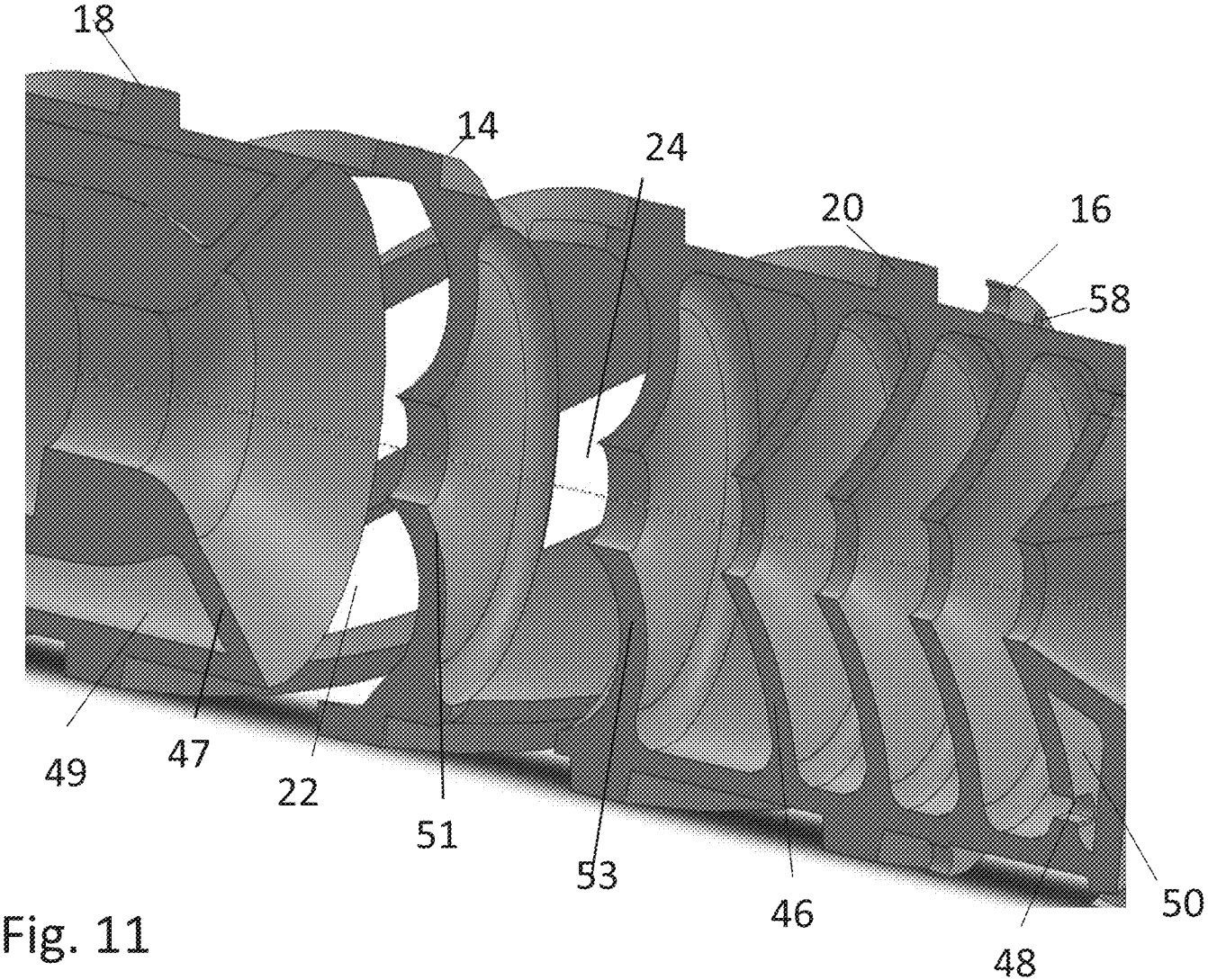
FIG. 11 is a cutaway perspective view of a portion of the suppressor of FIG. 3 in accordance with aspects of the disclosure, showing part of the first chamber the second chamber and the fourth chamber and part of the third chamber, with the can removed.
Figure 12:
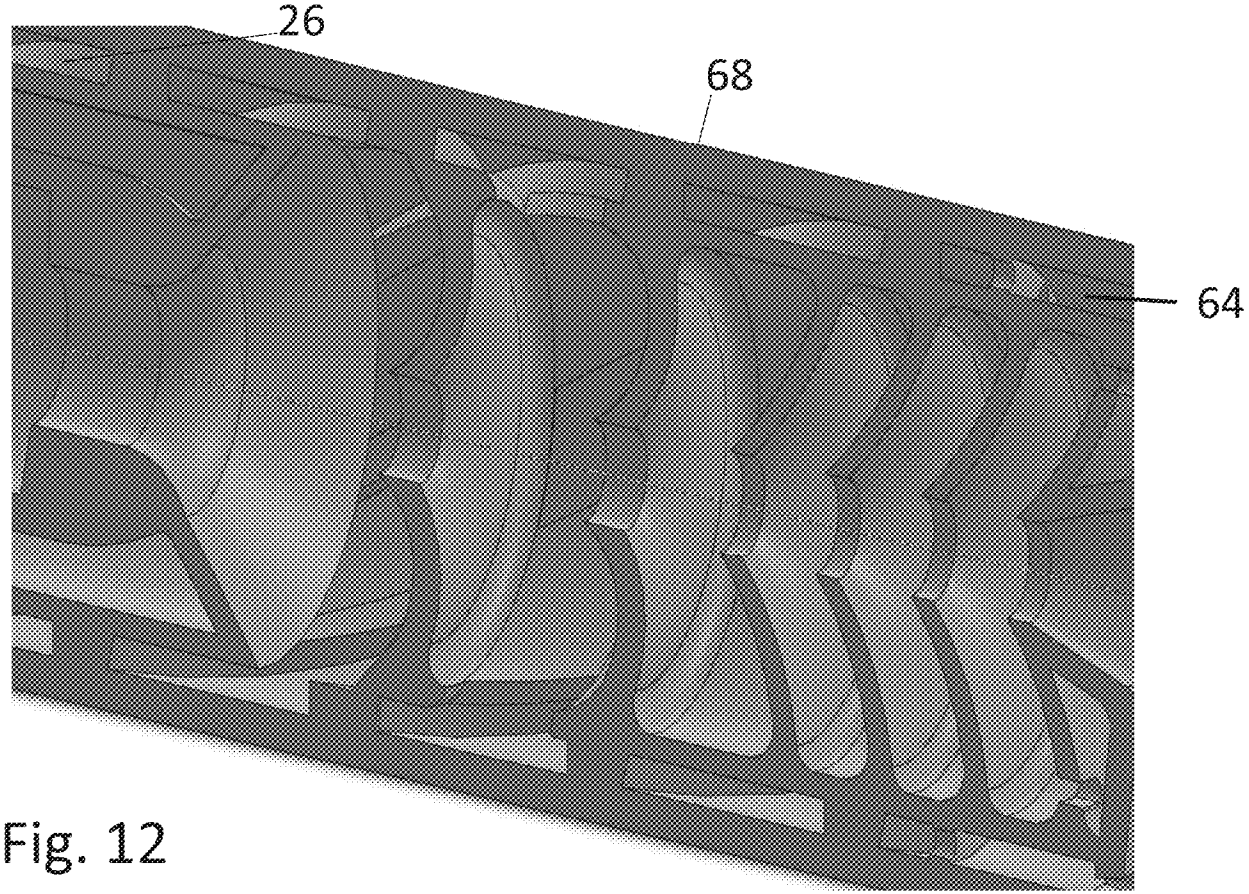
FIG. 12 is the same view as FIG. 11 with the can.
Figure 13:
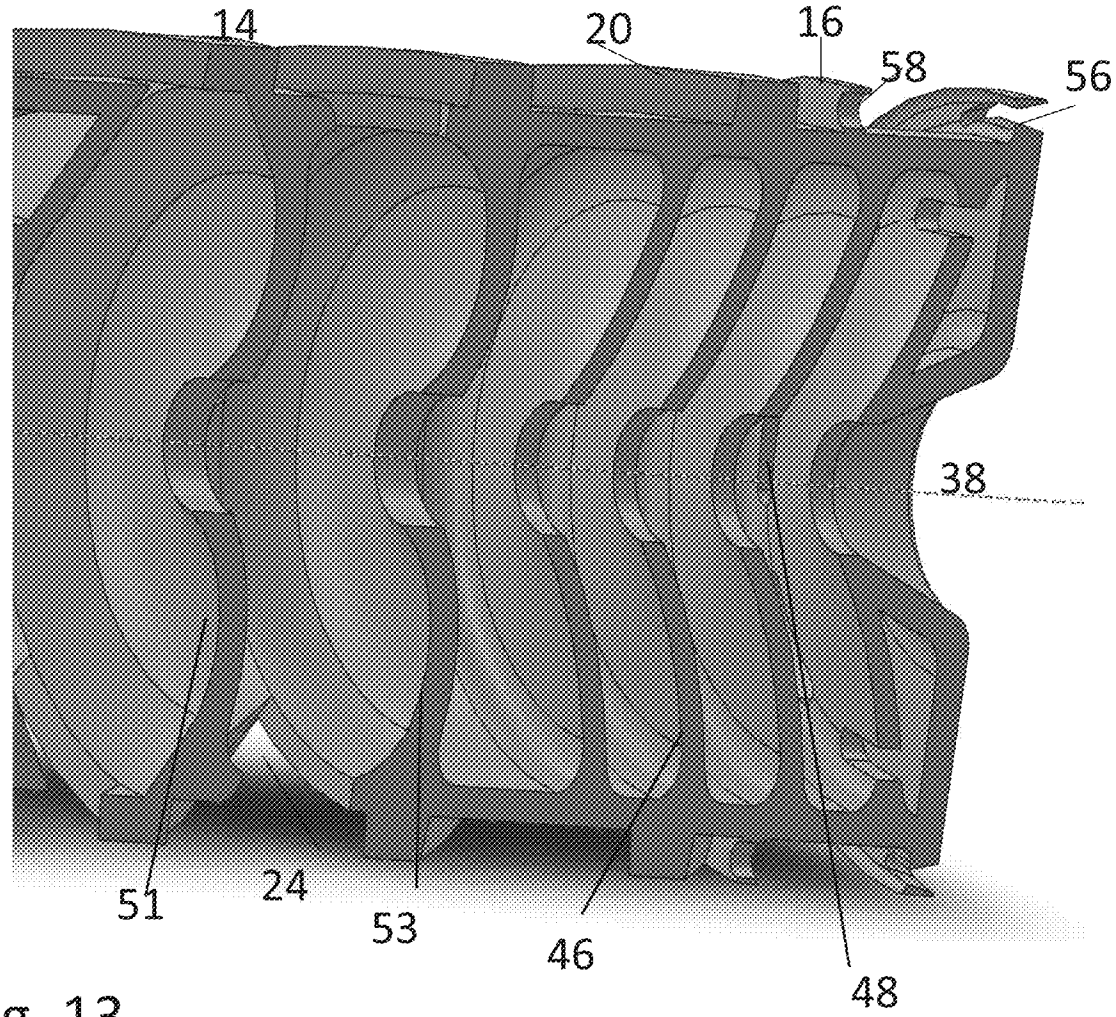
FIG. 13 is a cutaway view the suppressor of FIG. 3 in accordance with aspects of the disclosure, showing part of the second chamber, the third chamber and the fourth chamber, with the can removed.
Figure 14:
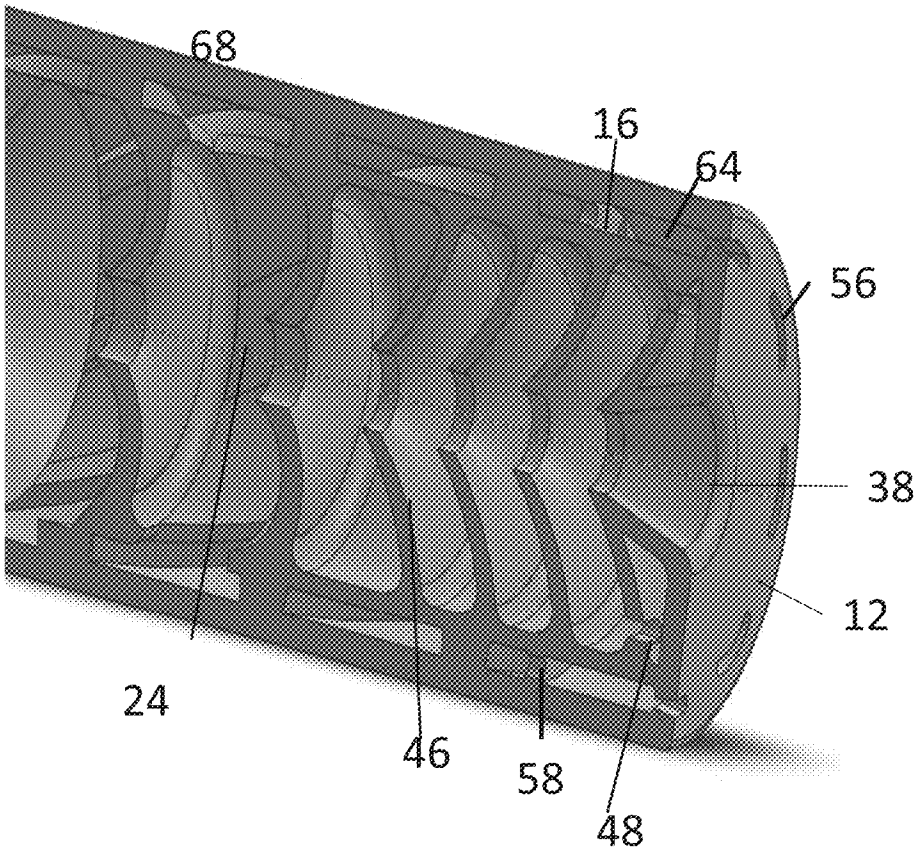
FIG. 14 is a cutaway perspective view a portion of the suppressor of FIG. 3 in accordance with aspects of the disclosure, showing part of the second chamber, the third chamber and fourth chamber with the can.
Figure 22:
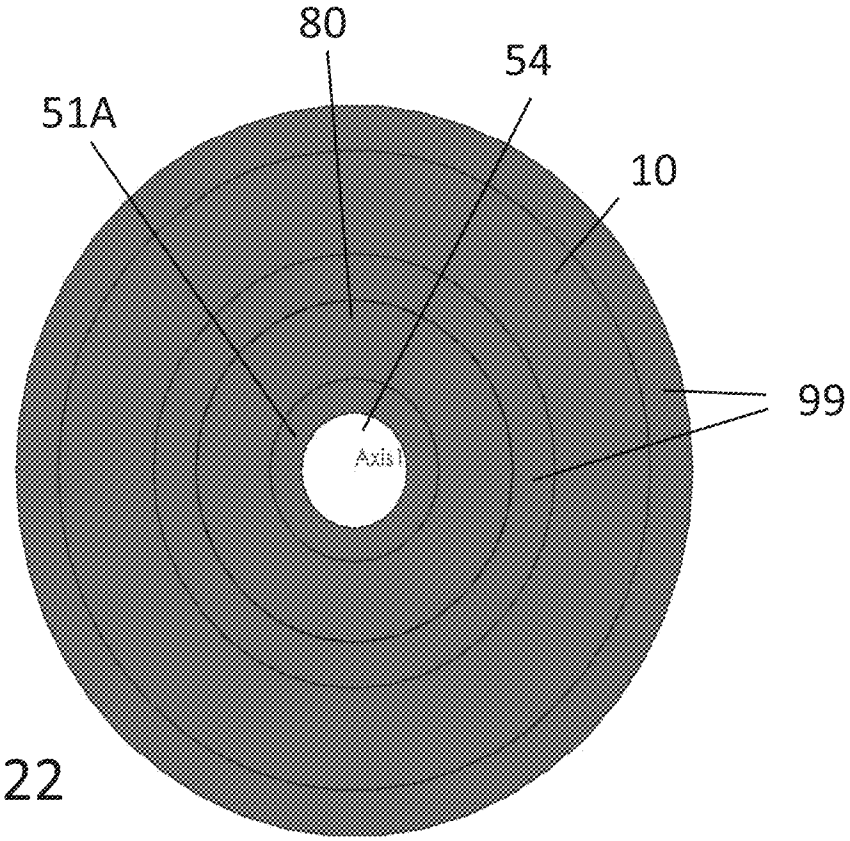
FIG. 22 is an end view from the proximal end of the suppressor of FIG. 19 in accordance with aspects of the disclosure.

The proximal end 102 of the suppressor 100 has a proximal end wall 10 and the distal end 104 of the suppressor 100 has a distal end wall 12. The proximal end wall 10 is shown in FIGS. 3, 6 and 10. As shown, for example, in FIG. 6 the proximal end wall 10 has a barrel opening 54 for receiving the barrel (see FIG. 1A). The external edges of the proximal end wall may be flat (as shown in FIG. 6) or rounded (filleted 99) as shown in FIG. 22. The diameter of the opening 54 is based on the type of firearm 150. The proximal end wall 10 has an inner surface 52 as seen in at least FIGS. 3-5 and 10. As shown in the figures, the inner surface 52 has a curved surface to smoothly guide the diverted gases within the annular gap 32 toward a space 49 (which will be described later).

Figure 9:
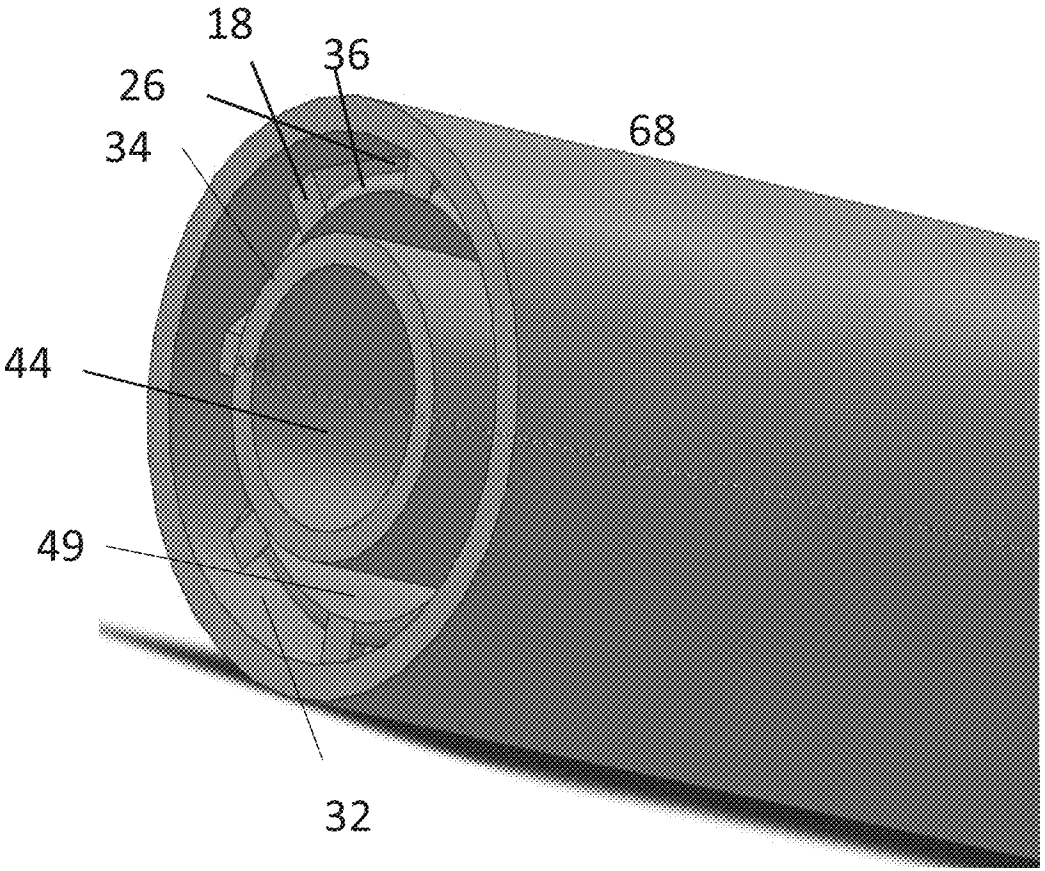
FIG. 9 is a perspective view of the proximal end of the suppressor of FIG. 3 in accordance with aspects of the disclosure with the proximal end wall removed.

The suppressor 100 comprises an inner wall 34 (see, e.g., FIGS. 3 and 9). The inner wall 34 extends from the inner surface of the proximal end wall 52. The inner wall 34 surrounds the opening 54. The inner wall 34 extends toward the distal end 104. The inner wall 34 has a contact portion 45 and an angled portion 47 (see, e.g., FIGS. 4 and 10).

The contact portion 45, when the muzzle 154 of the firearm 154 is inserted in the suppressor 100 contact the muzzle 154. The dimensions of the contact portion, e.g., length in a longitudinal direction, is based on the type of firearm 150 used and its barrel 152. The contact portion 45 also includes a stop 80 which prevents the muzzle 154 from being inserted further into the suppressor 100.

The contact portion 45 may have an attachment means for affixing the suppressor 100 to the muzzle 154 of the firearm 150. The attachments means (not shown) may be any known means include internally formed threads, a cam-lock fastener, a clamp, a screw or any other known means. The threading may be formed via 3D printing.

The angled portion 47 extends from a distal end of the stop 80 to an outer wall 36 of the suppressor 100. The angled portion 47 is angled with respect to the contact portion 45. The angled portion 47 is shown in at least FIGS. 4, 5 10 and 11. The angled portion 47 has a funnel like shape, with the larger diameter being toward the distal end 104.

Each of the figures shows a hashed line from the proximal end 102 to the distal end 104 and through the center of the suppressor labeled Axis 1. This is the center axis in the longitudinal direction. The projectile will follow this path through the suppressor 100 and exist via the main exit 38 in the distal end wall 12. The diameter of the projectile path is also based on the type of firearm 150 and projectile used.

The angled portion 47 has two main purposes. In an aspect of the disclosure, the angled portion 47 allows gases which are emitted by the firearm 150 to expand and be diverted from the main projectile path toward the outer wall 36 (and first openings 22 which will be described later).

In other aspects of the disclosure, the angled portion 47 also prevents the same gases from moving further forward (toward the distal end 104) once the gases are diverted into the space 49 of the first chamber 60 (the first chamber will be described with respect to FIG. 5).

The suppressor 100 also comprises an outer wall 36. The outer wall 36 extends between the distal end 104 and the proximal end 102. However, the outer wall 36 is not directly connected to the proximal end wall 102. In other words, as shown in at least FIGS. 3-5 and 10 there is a space or gap between the proximal end wall 10 and the outer wall 36. The outer wall 36 extends from the distal end wall 10, e.g., contacts the wall.

The outer wall 36 is has a cylindrical shape. As shown in FIGS. 9 and 10, the proximal edge of the outer wall 36 is curved and has a smoothed shape. This is to smoothly guide the diverted gases into the annular gap 32.

Figure 5:
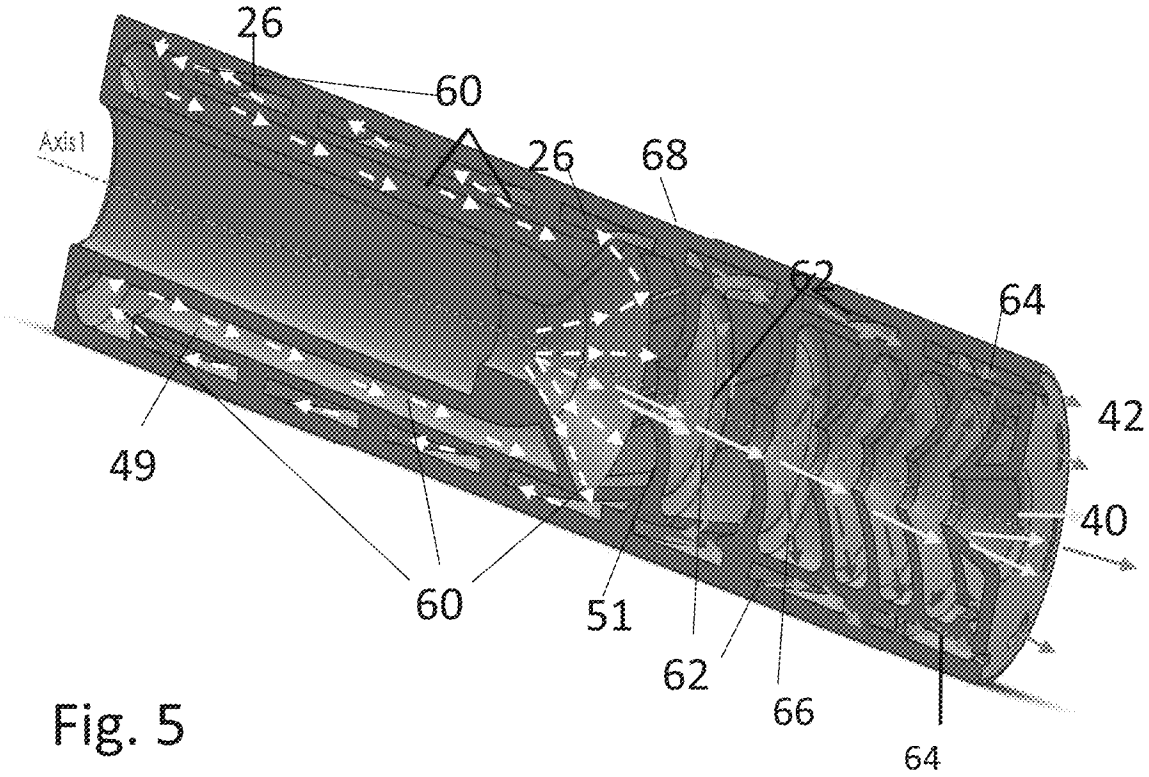
FIG. 5 is a perspective cutaway view of the suppressor of FIG. 3 with the can in accordance with aspects of the disclosure.
Figure 6:
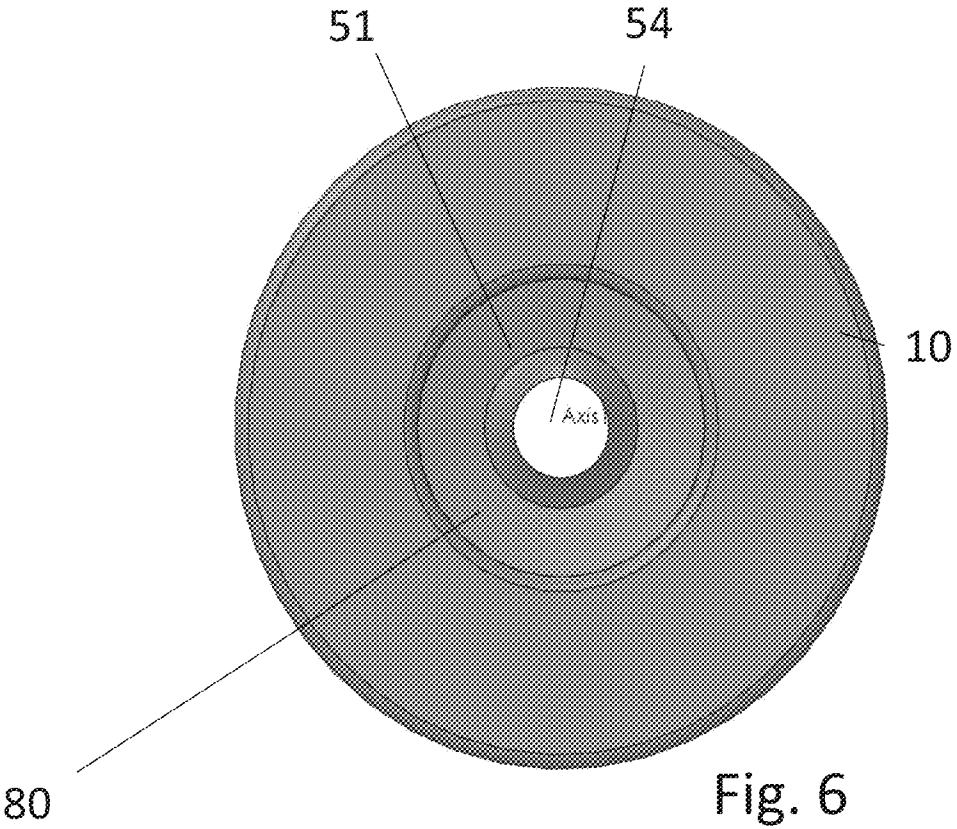
FIG. 6 is an end view from the proximal end of the suppressor of FIG. 3 in accordance with aspects of the disclosure.

The suppressor 100 comprises a can 68; the can 68 is disposed around the outer wall 36 as shown in FIG. 5. The can 68 extends from the proximal end wall 10 to the distal end wall 12. In an aspect of the disclosure, the can 68 may be printed as an integral piece with the proximal end wall 10 and the distal end wall 12. In other aspects of the disclosure, the can 68 may be separate and attached to the proximal end wall 10 and the distal end wall 12 via known attachment means. The can 68 comprises an outer surface which is exposed to the ambient atmosphere and a inner surface. The inner surface of the can defines an outer boundary of the channels for the diverted gases to flow, e.g., in chambers 1-3 (60-64).

When the can 68 is mounted, since the outer wall 36 does not contact the proximal end wall 10, the inner surface of the can faces the outer surface of the inner wall 34 and defines an annular gap 32 for the diverted gases to flow radially inward.

The suppressor 100 comprises two annular ribs including a barrier rib 14 and an annular rib 16. These ribs 14/16 extend between the outer surface of the outer wall 36 (outer surface is not labeled in the figures) and the inner surface of the can 68 (inner surface is not labeled in the figures). For example, these ribs 14/16 may be manufactured via 3D-printing.

Figure 15:
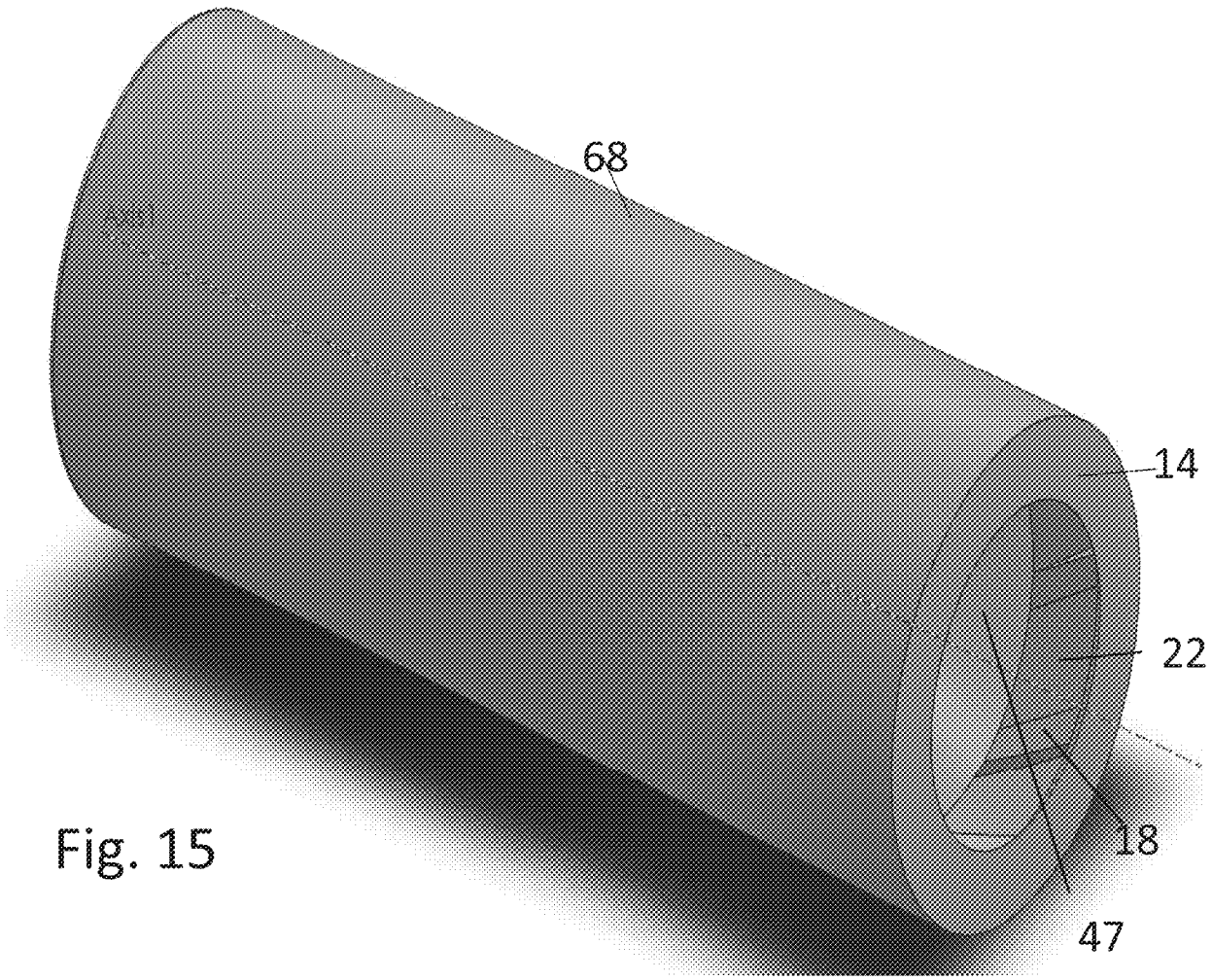
FIG. 15 is a perspective view of a portion of the suppressor of FIG. 3 from the proximal end to the barrier rib (sliced through the barrier rib)

The barrier rib 14 separates the first chamber 60 and the second chamber 62. In other words, the barrier ribs prevents gases that are flows in diverted paths (also referenced as first channels) in the first chamber 60 (e.g., between the outer wall 36 and can 68) from entering the diverted paths (also referenced as second channels) in the second chamber 62 (e.g., between the outer wall 36 and can 68). As shown in FIG. 15, the barrier rib 14 is solid and extends around the outer wall 36 of the suppressor 100 without breaks (FIG. 15 is a sectional view sliced though the barrier rib 14).

Figure 4:
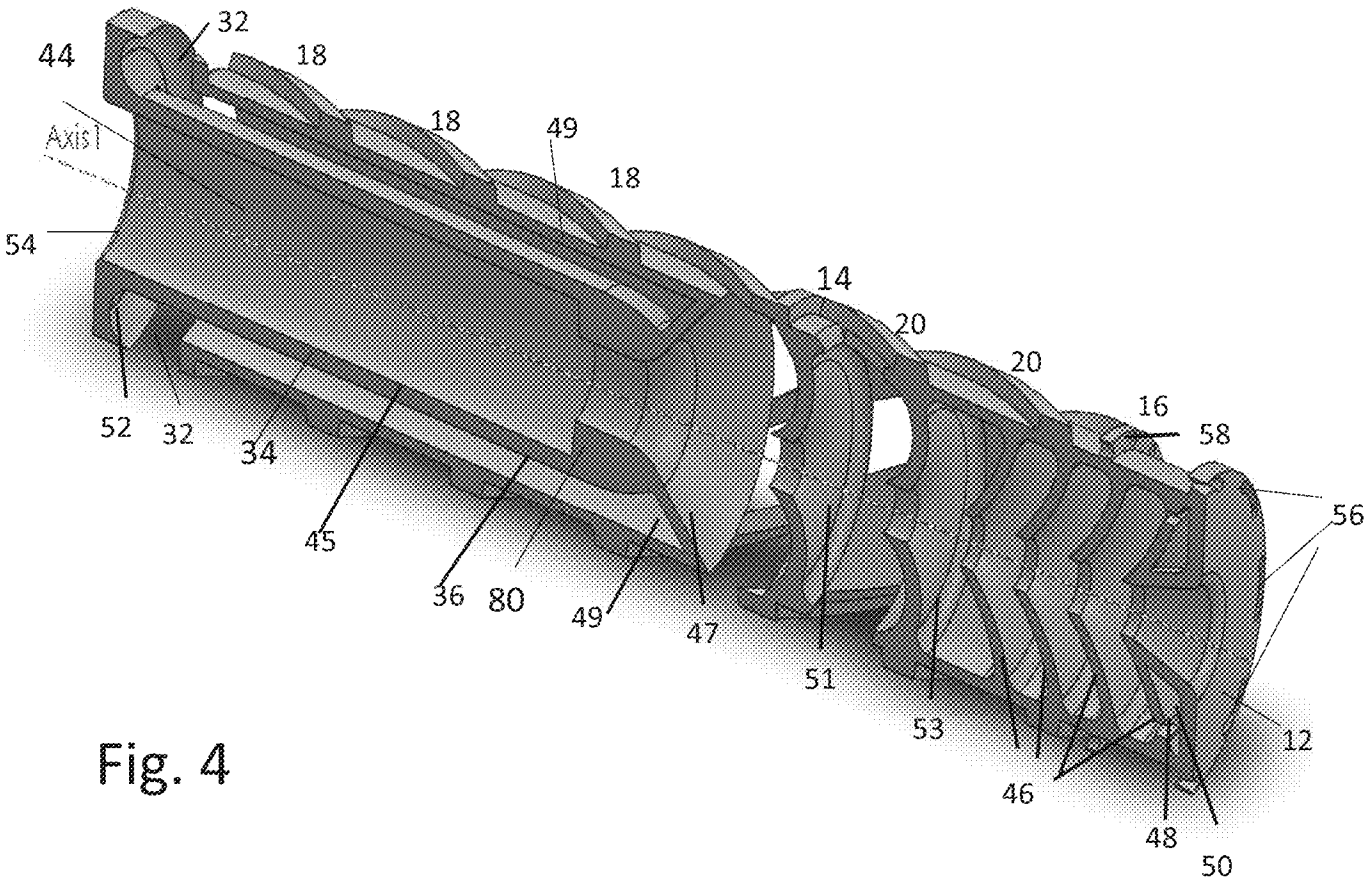
FIG. 4 is a perspective cutaway view of the suppressor of FIG. 3 without the can in accordance with aspects of the disclosure.

As shown in FIG. 4, the barrier rib 14 is between the angled portion 47 and the distal end wall 12 in the longitudinal direction. For example, in an aspect of the disclosure, the barrier rib 14 may be positioned near the middle of the suppressor 100 in the longitudinal direction. However, the location of the barrier rib 14 may depend on the type of firearm 150.

Figure 16:
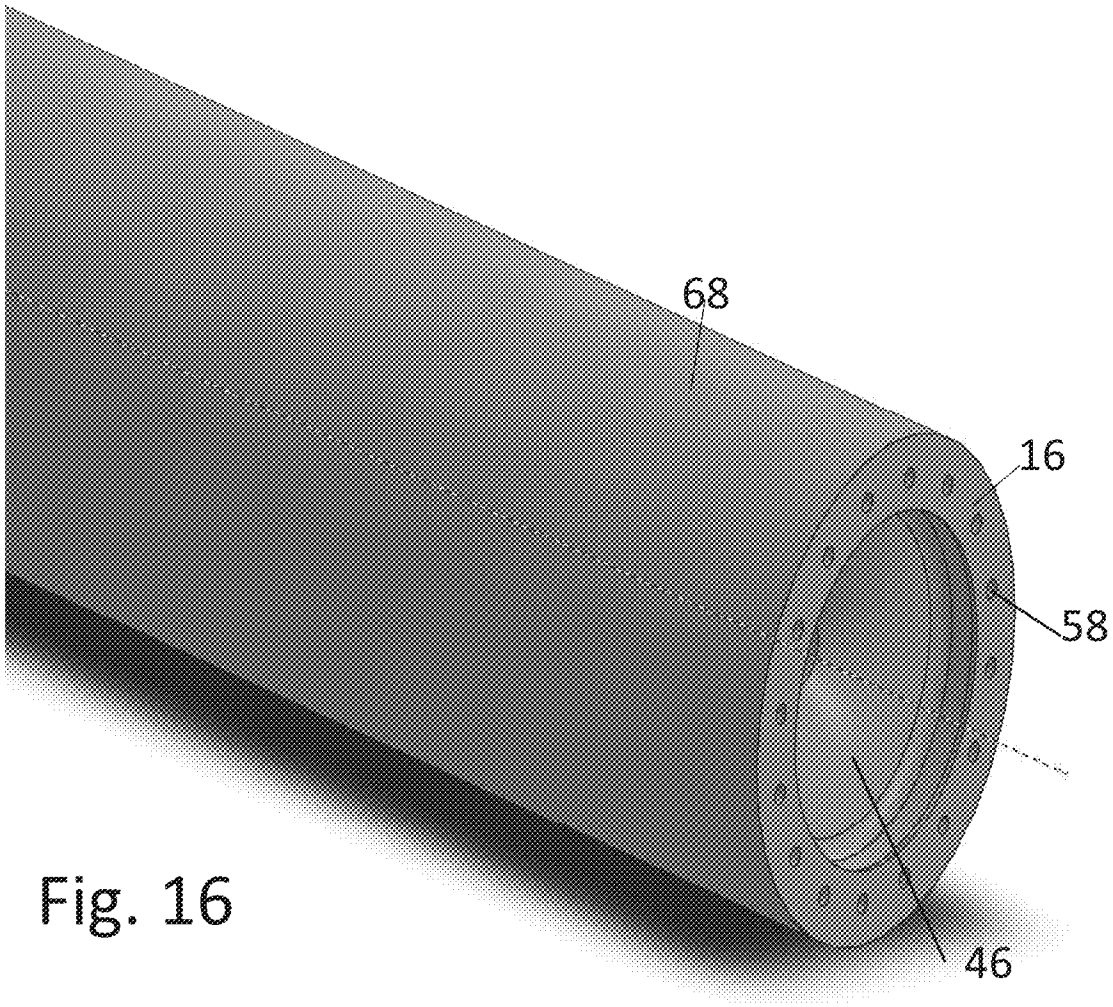
FIG. 16 is a perspective view of a portion of the suppressor showing the vents in the annular rib between the second chamber and the third chamber.

The annular rib 16 separates the second chamber 62 and the third chamber 64. However, unlike the barrier rib 14, the annular rib 16 has a plurality of vents 58. These vents allow gases flowing in the second chamber 62 to enter the third chamber 64 and vice versa. The vents 58 are shown in at least FIGS. 4, 11, 13 and 16. As shown, for example, in FIG. 16, the vents 58 have a circular shape, however, the shape and size of the vents and the number of vents may be adjusted depending on the type of firearm and projectile and the desired performance of the suppressor (FIG. 16 is a sectional view sliced through the annular rib 16). For example, the shape, size and number of the vents 58 will impact the timing that gases escape the suppressor 100 via the vents 56 in the distal end wall 12 (which will be described later in detail).

As shown in at least FIGS. 3 and 4, the annular rib 16 is between the barrier rib 14 and the distal end wall 12 in the longitudinal direction (and closer to the distal end wall 12). However, the location of the annular rib 16 shown is just an example and may be changed depending on the type of firearm and projectile and the desired performance of the suppressor.

The barrier rib 14 and the annular rib 16 may have a ring-like shape. As shown, both ribs are parallel to the end walls 10/12. However, in other aspects of the disclosure, the ribs 14/16 may have a different orientation as long as the ribs 14/16 extend around the circumference of the outer wall 36.

A plurality of ribs 18 (referenced herein as first chamber ribs) extends between the barrier rib 14 and the proximal end of the outer wall 36. The ribs 18 also extend from the outer surface of the outer wall 36 to the inner surface of the can 68.

The ribs 18 may extend in a straight line between the barrier rib 14 and the proximal end of the outer wall 36. In other aspects of the disclosure, as shown in at least FIGS. 3, 4 and 11, the ribs 18 may extend in a spiral arrangement. The distance between each adjacent ribs 18 may be constant. In other aspects of the disclosure, the distance between adjacent ribs 18 may be different. In other aspects of the disclosure, the distance between adjacent ribs 18 may change from the barrier rib 14 to the proximal end of the outer wall 36.

In accordance with aspects of the disclosure, adjacent ribs 18, respectively, form or define a space or channel 26 for diverted gases to flow (first chamber channels). As shown in at least FIGS. 3 and 5, the diverted gases flow toward the proximal end in these channels 26.

The outer wall 36 has a plurality of first openings 22. These openings 22 are interleaved between adjacent ribs 18 in the circumferential direction. The openings 22 are disposed adjacent the barrier rib 14 and extend toward the proximal end in the longitudinal direction. In an aspect of the disclosure, the openings 22 extend between the angled portion 47 and the barrier rib 14 in the longitudinal direction. However, the length of the openings 22 may vary depending on the type of firearm and projectile and the desired performance of the suppressor.

The first openings 22 are gas-transfer ports for allowing the diverted gases, which have expanded and been diverted from the projectile path, to enter the first channels 26 of the first chamber 60.

A plurality of ribs 20 (referenced herein as second chamber ribs) extends between the barrier rib 14 and the annular rib 16. The ribs 20 also extend from the outer surface of the outer wall 36 to the inner surface of the can 68.

Like ribs 18, the second chamber ribs 20 may extend in a straight line, e.g., between the barrier rib 14 and the annular rib 16. In other aspects of the disclosure, as shown in at least FIGS. 3, 4 and 11, the ribs 20 may extend in a spiral arrangement. The distance between each adjacent ribs 20 may be constant. In other aspects of the disclosure, the distance between adjacent ribs 20 may be different. In other aspects of the disclosure, the distance between adjacent ribs 20 may change from the barrier rib 14 to the annular rib 16.

In accordance with aspects of the disclosure, adjacent ribs 20, respectively, form or define a space or channel for diverted gases to flow (second chamber channels). However, unlike the channels 26, the channels in the second chamber include some for flowing toward the distal end 104 and other channels for flowing toward the proximal end as shown in FIG. 3. In accordance with this aspect of the disclosure, the outer wall 36 includes a plurality of second openings 24. In an aspect of the disclosure, the openings alternate channels. Some adjacent ribs 20 have an opening 24 between them while others do not. For example, one rib 20 may not have an opening 24 on both sides of the rib in the circumferential direction.

Where present, the openings 24 are adjacent to the barrier rib 14. The openings 24 extend toward the distal end 104 in the longitudinal direction.

Since there is not an opening 24 between each adjacent rib 20, the number of second openings 24 is less than the number of first openings 22. The difference is shown in at least FIG. 11 (showing the openings without the can 68).

The openings 24 are gas-transfer ports for allows the diverted gases, which have expanded and been diverted from the projectile path, to enter the channels 30 in the second chamber 62 for flowing toward the distal end 104.

For adjacent ribs where there is no opening between them, the outer wall 36 connects to the barrier rib 14 and the ribs 20 define channels 28 for allowing the diverted gases to flow toward the barrier rib 14.

Figure 7:
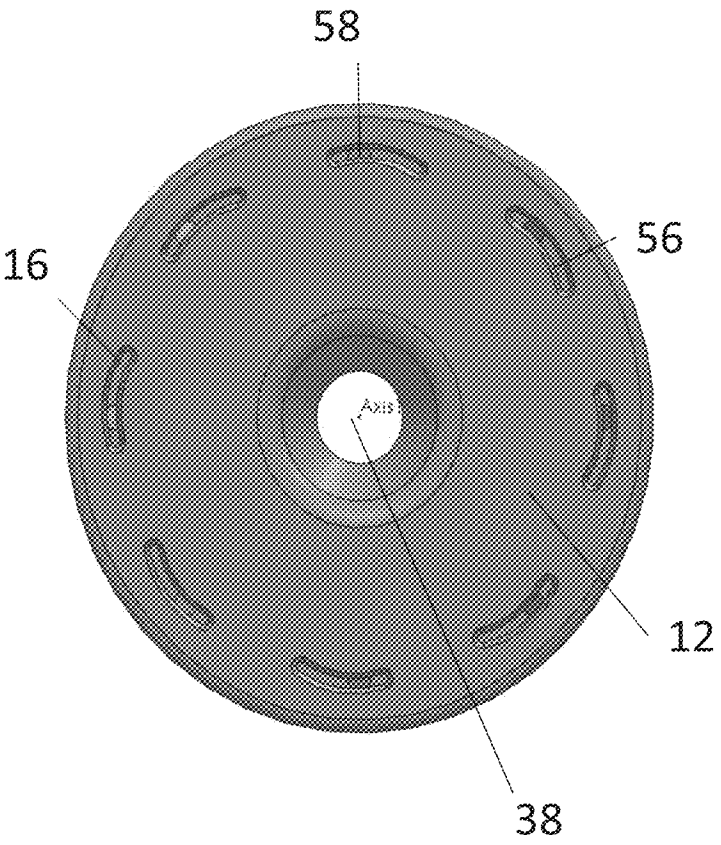
FIG. 7 is an end view from the distal end of the suppressor of FIG. 3 in accordance with aspects of the disclosure.
Figure 8:
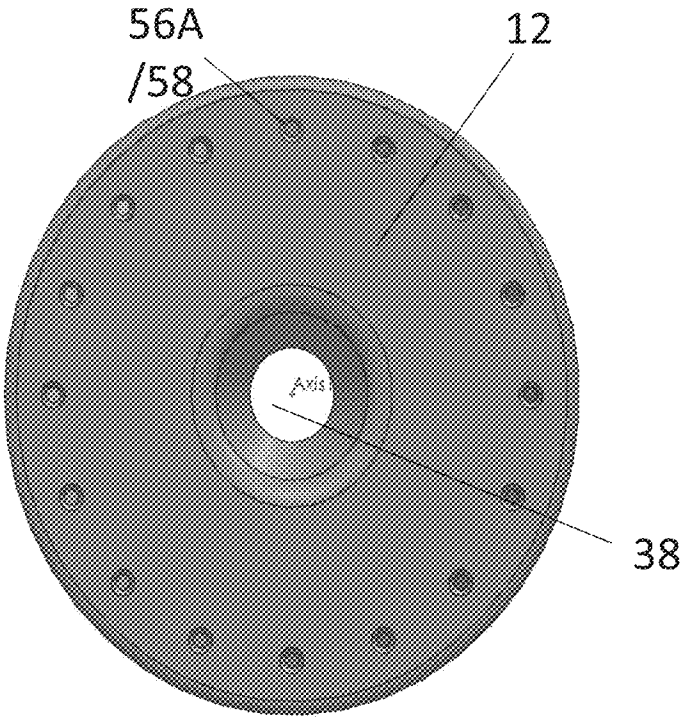
FIG. 8 is another end view from the distal end of a suppressor in accordance with other aspects of the disclosure showing other examples of vents.

The distal end wall 12 has a main exit 38 as shown in FIG. 7 (end view) (and also FIG. 8 showing an alternate distal end wall). The diameter of the main exit 38 may be based on the type of projectile. In accordance with aspects of the disclosure, the distal end wall 12 further comprises a plurality of vents 56. The vents 56 are disposed near the outer edge of the end wall 12 to be aligned with the third chamber 64 in the longitudinal direction. The vents 56 are configured to allow the diverted gases to escape the suppressor 100 in the form of a slip stream 42 (see, e.g., FIGS. 3 and 5). As shown in FIG. 7, the vents 56 are slits in the wall 12. However, the vents 56 may have other shapes such as circular 56A which is shown in FIG. 8 as an alternative. The vents 56 may be aligned in the longitudinal direction with the vents 58 in the annular rib 16 (as shown in FIG. 7). The annular rib 16 is also shown in the end view in FIG. 7.

However, the vents 58 also may be offset. As with vents 58, the shape, size and number of the vents 56 in the distal end wall 12 may vary depending on the type of firearm and projectile and the desired performance of the suppressor.

The suppressor 100 further comprises non-linear walls 51, 53. The non-linear walls are shown in at least FIGS. 4, 11 and 13.

The non-linear wall 51 is disposed between the first openings 22 and the second openings 24. The non-linear wall 51 extends inward from the inside surface (not labeled) of the outer wall 36. The non-linear wall 51 as a central opening (not labeled). The central opening is aligned with the main exit 38 and the main projectile path. The central opening is configured to allow the projectile to path there through. The non-linear wall 51 is shaped to smoothly guide the expanded and diverted gases toward the first openings 22. In aspect of the disclosure, the non-linear wall 51 has a c-shape (as viewed in a section) as shown in partial cutaway views of FIG. 11 or FIG. 13.

The non-linear wall 53 is disposed on the opposite end of the second openings 24 from the non-linear wall 51 (in the longitudinal direction). The structure of non-linear wall 53 is the same as non-linear wall 51 and will not be described again. The non-linear wall 53 is shaped to smoothly guide the expanded and diverted gases toward the second openings 24.

The suppressor 100 further comprises a plurality of baffles 46 as shown in at least FIGS. 4, 11, 13 and 14. Like, the non-linear walls 51, 53, each baffle also has a central opening. All of the openings are aligned with the main exit 38.

Each baffle 46 has a surface for diverting gases from the projectile path toward the outer wall 36. In accordance with certain aspects of the disclosure, one or more of the baffles 46 may have a slit 48 for moves the diverted gases therebetween or moving the diverted gases into a pocket 50 for temporary holding. The slit 48 and pocket 50 are shown in at least FIGS. 4 and 11-14. The number of slits, size and shape of the slits and the pocket size may vary depending on the type of firearm and projectile and the desired performance of the suppressor.

In an aspect of the disclosure, the spacing between each baffle 46 is the same. However, in other aspects of the disclosure, the spacing between baffles 46 may be different. For example, in some aspects of the disclosure, the baffles 46 closer to the non-linear wall 53 may have a first spacing and the baffles 46 closer to the distal end wall 12 may have a second spacing.

Flow of the diverted gases within the suppressor 100 will now be described in detailed with reference to FIGS. 3 and 5 (and certain partial views of the suppressor 100). Diverted gas flow in the first chamber 60 is shown in the figures with dashed lines having a short dash. Diverted gas flow in the second chamber 62 is shown in the figures with lines with one or two dots. Diverted gas flow in the third chamber 64 is shown in the figures with doted lines with multiple dots. Diverted gas flow in the fourth chamber 66 is shown in the figures with dashed lines with long dashes. Gas flowing in the projectile gas (that is not diverted) is shown with solid lines. This gas exits the main exit 38 as the main gas flow 40.

When a projectile is discharged from a firearm 150 into the suppressor 100, the projectile progresses through the projectile path towards the main exit 38. In concert with this progression, gases (such as pressure gases) pass through the same. However, some of the gases are diverted into the various chambers by components of the suppressor 100. As shown in FIG. 5, some of the gases are guided by the angled portion 47 and the shape of the non-linear wall 51 toward the first openings 22 (see, e.g., FIG. 3). The gases then enter the channels 26 of the first chamber 60 and flow (in a spiral pattern) toward the proximal end of the suppressor 100. Once the gases reach the edge of the outer wall 36 (see FIG. 3), the gases will move radially inward via the annular gap 32 and into the space 49 until it reaches the angled portion 47, which acts as a barrier. FIG. 10 is a partial view showing the first chamber 60. The first chamber 60 path is continuous and includes the first channels 26, annular gap 32 and space 49 and the diverting area between the angled portion 47 and the non-linear wall 51.

Eventually over time, as the pressure subsides, the gases flowing toward the barrier (angled portion 47) and at the barrier will reverse and exit the suppressor 100 via either the vents 56 or main exit 38.

Some of the gases that were not diverted into the first chamber 60 and remain in the projectile path, will be diverted into the second chamber 62 (as the projectile continues to move toward the main exit 38). In this case, the gases are diverted by the non-linear wall 53 (an expansion) toward the second openings 24. As shown in FIGS. 3 and 5, these gases will flow through the openings 24 into channels 30 toward the distal end. Once the gases reach the annular rib 16, the gases will transfer from the second chamber 62 to the third chamber 64 via vents 58.

Some of this gas will escape the suppressor 100 via the vents 56 as the slip stream 42. Other of the gas will return via the vents 58 to the second chamber 62 and flow through channels 28 until it reaches the barrier rib 14. As with the gases in the first chamber 60, the gases within the second chamber will exit the suppressor over time as pressure subsides via vents 56 (or main exit 38).

The gases that were not diverted into the first-third chambers 60, 62 and 64, and remain in the projectile path, may be diverted (expand) into the fourth chamber 66 as the projectile continues toward the main exit 38. As shown in FIG. 5, the gases may be diverted by each baffle 46 (expand) into respective areas (toward the outer wall 36). Where a baffle 46 also includes a slit 48, the gases may also pass between baffles 46 or into the pocket 50 (see, e.g., FIGS. 13 and 14). This gas will exit the suppressor over time as pressure subsides via the main exit 38.

Gases not diverted will exit the main exit 38 as the main gas flow 40.

The chambers 60, 62, 64 and 66 provide a volume for the diverted gases to expand, thus, reduces the pressure of the gas 40 which exits main exit 38. Additionally, the chambers 60, 62, 64, and 66 increase the time that the gases are within the suppressor 100 thus ensuring a more complete burn of the explosive charge generating the gases, thus reducing blast and flash. The increase in time also reduces the energy flow rate. However, the increase in time is countered by the venting 56 in the distal end wall 12 (and vents 58). The vents reduce the amount of heat absorbed by the suppressor 100 by allowing gases to escape quicker.

The gases exiting the vents 56 also form a slip stream 42 around the gases 40 that exit the main exit 38. The slip stream 42 minimizes a mushroom of gases (with would otherwise occur) and any gases entrained are previously burnt gases, and thus minimize the conditions for secondary ignition. In a known suppressor, as the gases that have exited slow down, a mushroom is formed (as the exit gases push through the slowing gases). This mushrooming effect will entrain fresh air (oxygen) into the hot circulating gases, and potentially result in secondary ignition as the gases coming out of the suppressor are not fully combusted. With the disclosed suppressor 100, the slip stream 42 will mix with gases 40 exiting the main exit 38 and the mixture will not combust due to insufficient oxygen.

The slip stream 42 also creates destructive interference with the sound emitted as the gas 40 exits the main exit 38. This is achieved by controlling the timing of the slip steam 42 exiting the vent 56. As described above, the number of vents 56, 58 (size and shape) may be set based on performance and the pitch of the ribs 18, 20 may be set to control the timing that the slip stream 42 exits the vents 56. This is also based on the type of firearm 150 and projectile. The size, shape, number of vents and pitch of the ribs is set based on CFD modeling for each application.

Moreover, the chambers 60, 62, 64 and 66 reduce the formation of mach disc as the gases 40 exit the main exit 38. This is because the speed (pressure) is reduced. This also reduces a potential for secondary ignition or a flash.

FIGS. 17-29 show another example of a suppressor 100A in accordance with aspects of the disclosure. In FIGS. 17-29 like parts between the suppressor 100A and 100 have the same label. Like parts will not be described again in detail. The following description focuses on the differences between the suppressors 100A and 100.

The suppressor 100A comprises gas expansion chambers. The second chamber described above is eliminated. For purposes on the description, the chambers will be described as first chamber 60A, third chamber 64 and fourth chamber 66A for consistency with the chamber description in suppressor 100.

Figure 18:
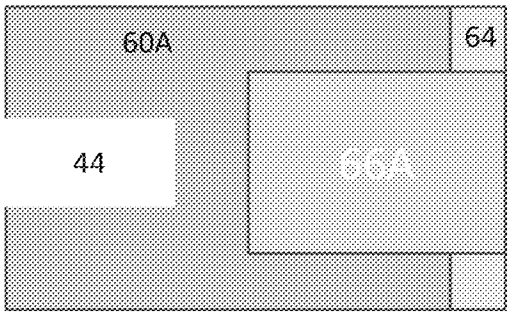
FIG. 18 is a drawing of the suppressor of FIG. 17 in accordance with aspects of the disclosure showing relative locations of gas expansion chambers.

The first chamber 60A is extended with respect to the first chamber 60 and occupies a space where part of the second chamber 62 occupied in the suppressor 100 as shown in FIG. 18. The fourth chamber 66A is extended with respect to the fourth chamber 66 and occupies a space where part of the second chamber 62 occupied in the suppressor 100 as shown in FIG. 18.

The suppressor 100A has an outer wall 36A extending from the proximal end wall 10 to the distal end wall 12A. Unlike the suppressor 100, there is no gap between the outer wall 36A and the proximal end wall 10. Additionally, the inner wall 34 is eliminated in the suppressor 100A.

Figure 19:
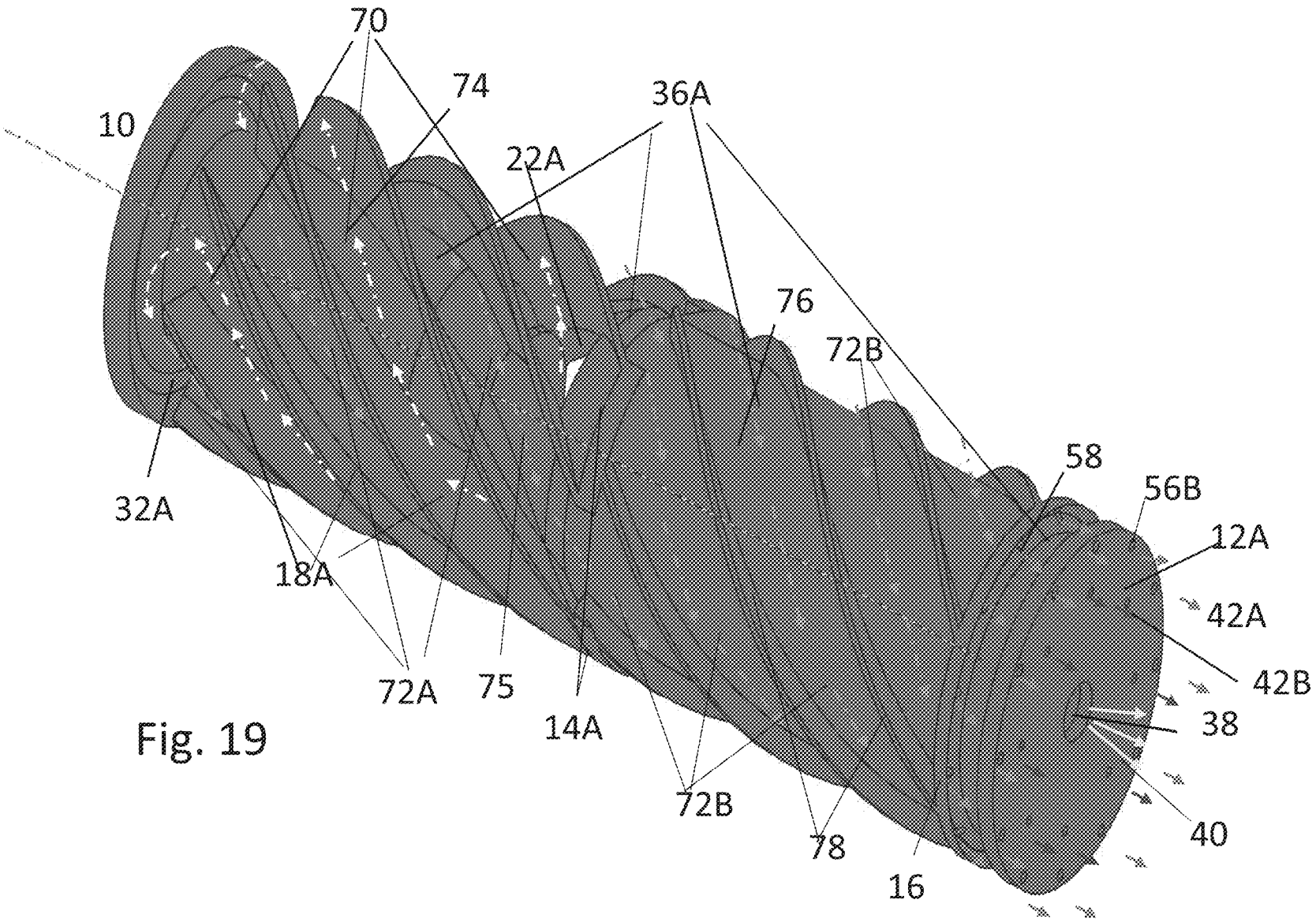
FIG. 19 is a perspective view of the suppressor of FIG. 17 without a can in accordance with aspects of the disclosure.
Figure 20:
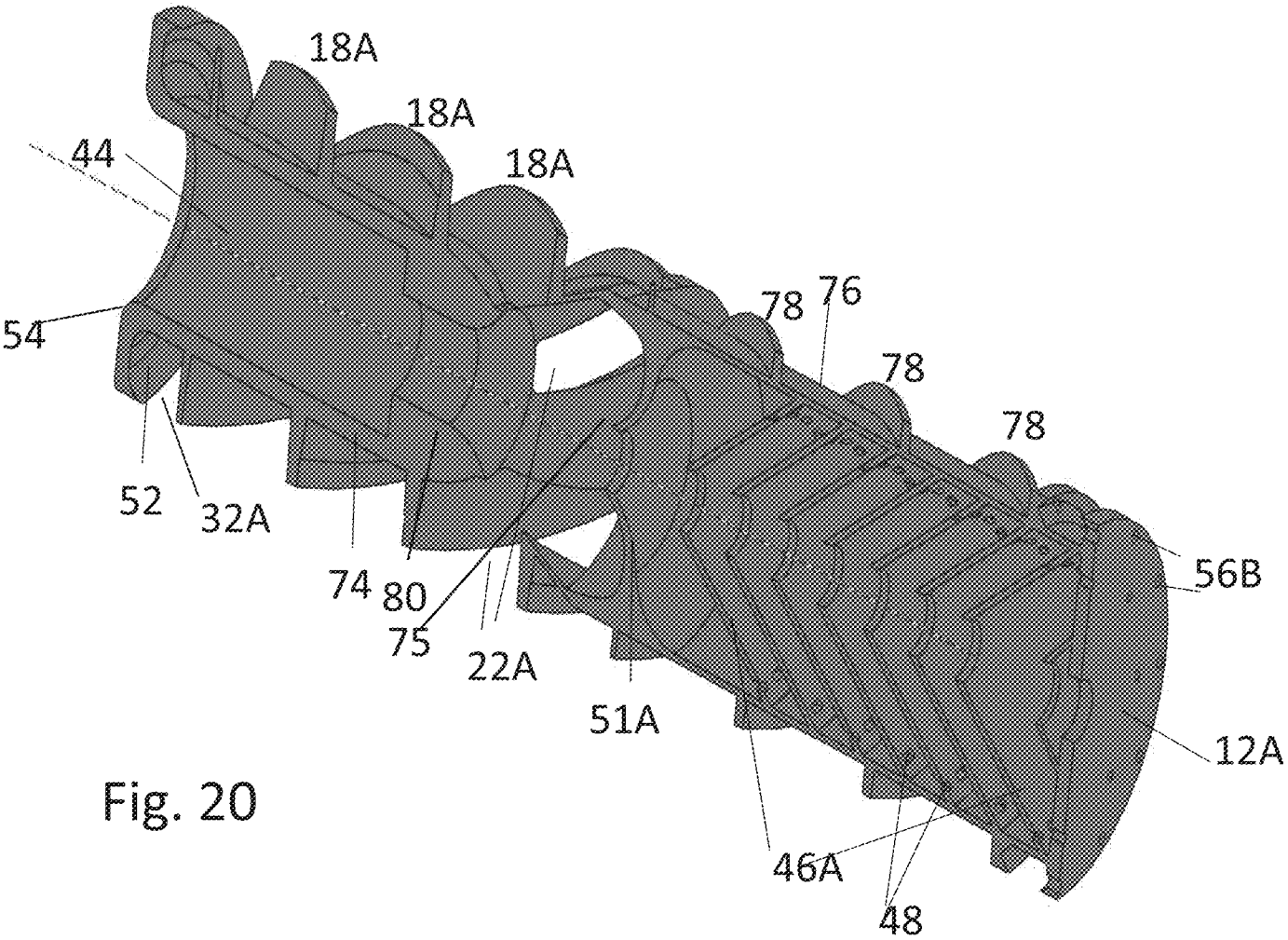
FIG. 20 is a perspective cutaway view of the suppressor of FIG. 19 without the can in accordance with aspects of the disclosure.

As shown in at least FIGS. 19 and 20, the outer wall 36A comprises a first portion 74, a second portion 76 and a third portion 75. The first portion 74 extends longitudinally from the proximal end wall 10 toward the distal end 104. The second portion 76 extends longitudinally from the distal end wall 12A toward the proximal end. The third portion 75 connects the first portion 74 and the second portion 76.

Figure 17:
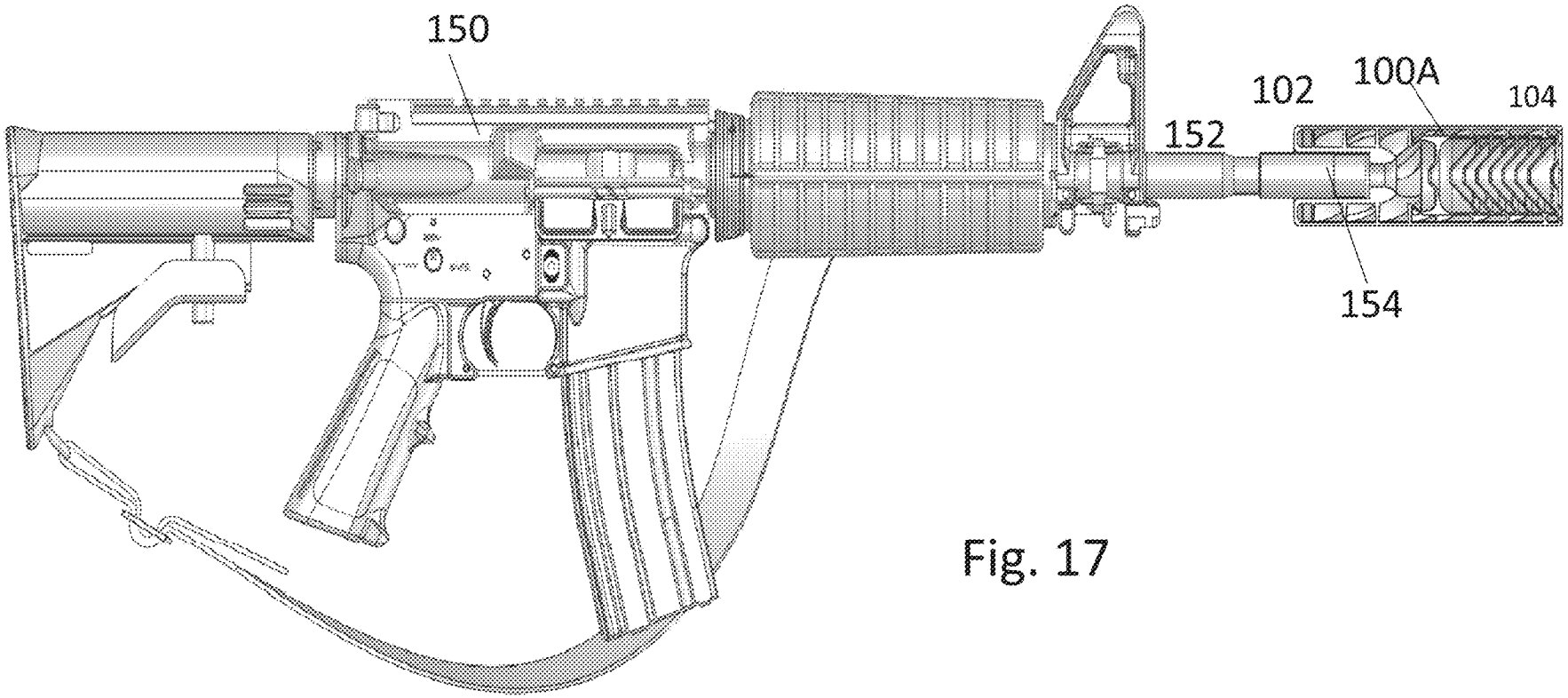
FIG. 17 is a cutaway side view of another suppressor installed on a firearm in accordance with other aspects of the disclosure.

The first portion 74 surrounds the opening 54 (see, e.g., FIG. 20). The inner surfaces of the wall 36A contact the muzzle 154 of the firearm, when the muzzle 154 of the firearm 150 is inserted in the suppressor 100A (FIG. 17 shows the suppressor 100A mounted on the firearm 150). The dimensions of the first portion, e.g., length in a longitudinal direction, is based on the type of firearm 150 used and its barrel 152. The wall 36A also includes a stop 80 which prevents the muzzle 154 from being inserted further into the suppressor (see, e.g., FIGS. 20 and 25).

The inner surface may have an attachment means for affixing the suppressor 100A to the muzzle 154 of the firearm 150. The attachments means (not shown) may be any known means include internally formed threads, a cam-lock fastener, a clamp, a screw or any other known means. The threading may be formed via 3D printing.

The third portion 75 extends from a distal end of the stop 80 to the second portion 76. The third portion 75 is angled with respect to the first portion 74 and the second portion 76 as shown in at least FIG. 20.

The suppressor 100A comprises a segmented barrier rib 14A (see, e.g., FIGS. 19, 28 and 29) and an annular rib 16. These ribs 14A/16 extend between the outer surface of the outer wall 36A (outer surface is not labeled in the figures) and the inner surface of the can 68 (inner surface is not labeled in the figures). For example, these ribs 14/16 may be manufactured via 3D-printing.

The annular rib 16 separates the first chamber 60A and the third chamber 64.

Figure 29:
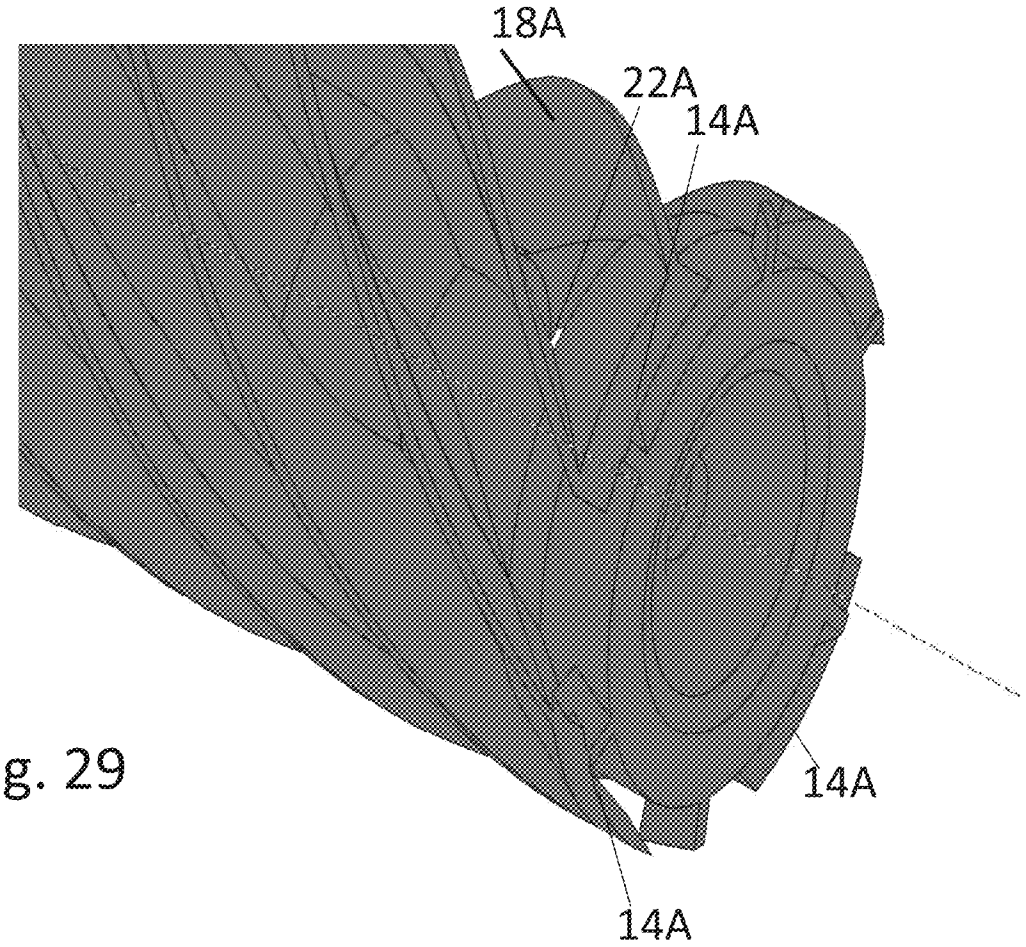
FIG. 29 is a perspective view showing the segmented barrier rib of the suppressor of FIG. 19.
Figure 30:
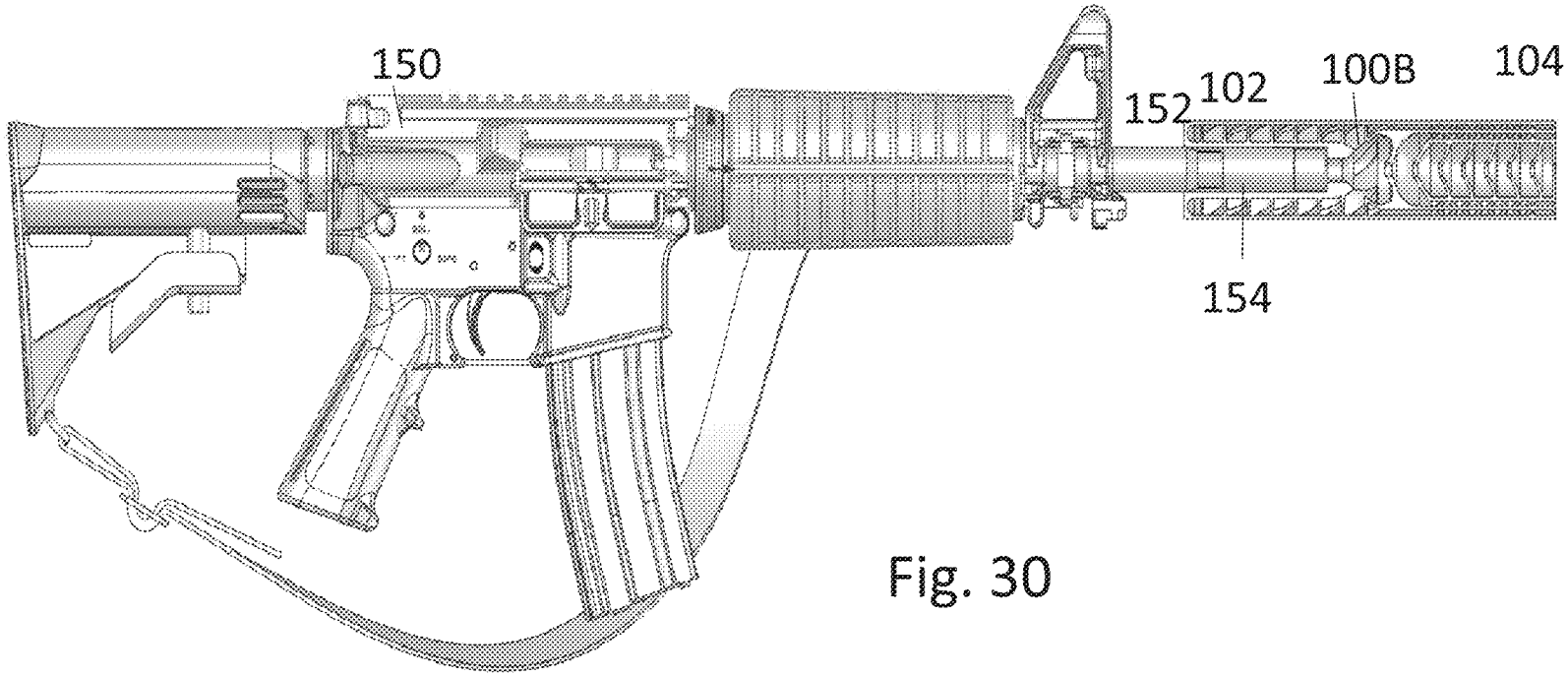
FIG. 30 is a cutaway side view of another suppressor installed on a firearm in accordance with other aspects of the disclosure.

The segmented barrier rib 14A has a plurality of segments (see, e.g., FIG. 29). Each segment extends in the circumferential direction as shown in at least FIG. 29. There is a space between adjacent segments. As will be described later, the segments of the segmented barrier rib 14A prevent diverted gases (flowing into the openings 22A and in channels 70 (upstream channels)) from flowing further toward the distal end 104.

The segmented barrier rib 14A may be positioned near the middle of the suppressor 100A in the longitudinal direction. However, the location of the rib 14A may depend on the type of firearm 150.

A plurality of ribs 18A (referenced herein as first chamber ribs) extends from the segment barrier rib 14A toward the proximal end wall 10. However, there is a gap 32A between the ribs 18A and the proximal end wall 10, e.g., the ribs do not contact the wall (see, e.g., at least FIGS. 19, 24 and 28). The gap 32A is the same between each rib 18A and the proximal end wall 10.

The ribs 18A extends from respective ends of each segment, e.g., two ribs extend from a segment.

The ribs 18A also extend from the outer surface of the outer wall 36A to the inner surface of the can 68.

The rib 18A may extend in a straight line. In other aspects of the disclosure, as shown in at least FIGS. 19, 20, 26, 28 and 29, the ribs 18A may extend in a spiral arrangement. The distance between each adjacent rib 18A may be constant. In other aspects of the disclosure, the distance between adjacent ribs 18A may be different. In other aspects of the disclosure, the distance between adjacent ribs 18A may change over its longitudinal length.

The outer wall 36A has a plurality of first openings 22A. The openings 22A are in the third portion 75. The number of opening equals the number of segments in the segmented barrier rib 14A. The openings 22A are disposed adjacent to the segments of the barrier rib 14A, respectively, and extend toward the proximal end 102 in the longitudinal direction. The length of the openings 22A in the longitudinal direction may vary depending on the type of firearm and projectile and the desired performance of the suppressor. The openings 22A alternate channels. In other words, the same rib 18A does not have openings on both sides of the rib 18A in the circumferential direction.

The first openings 22 are gas-transfer ports for allowing the diverted gases, which have expanded and been diverted from the projectile path, to enter the channels 70 of the first chamber 60A (as shown in at least FIG. 19).

In accordance with aspects of the disclosure, adjacent ribs 18A, respectively, form or define a space or channels 70/72A for diverted gases to flow. As shown in at least FIGS. 19 and 21, these channels 70 and 72A allow the diverted gases flow bi-directionally. For example, channels 70 allow the diverted gases to flow toward the proximal end 102 and channels 72A allow the diverted gases to flow toward the distal end 104. Because there is an annular gap 32A, the diverted gases can change direction and flow from channels 70 to channels 72A.

The outer wall 36A also has a plurality of ribs 78 extending between the segmented barrier rib 14A and the annular rib 16. The ribs 78 also extend from the outer surface of the outer wall 36A to the inner surface of the can 68. As depicted in at least FIGS. 19, 20 and 28, the ribs 78 extend to the segmented barrier rib 14A, however, in other aspects of the disclosure, there may be a gap between the ribs 78 and the segmented barrier rib 14A.

Like ribs 18A, the ribs 78 may extend in a straight line, e.g., between the segmented barrier rib 14A and the annular rib 16. In other aspects of the disclosure, as shown in at least FIGS. 19, 20 and 28, the ribs 78 may extend in a spiral arrangement. The distance between each adjacent rib 78 may be constant. In other aspects of the disclosure, the distance between adjacent ribs 78 may be different. In other aspects of the disclosure, the distance between adjacent ribs 78 may change from the segmented barrier rib 14A to the annular rib 16.

In an aspect of the disclosure, the number of ribs 78 may be less than the number of ribs 18A.

In accordance with aspects of the disclosure, adjacent ribs 78, respectively, form or define a space or channel 72B for diverted gases to flow toward the third chamber 64.

Figure 21:
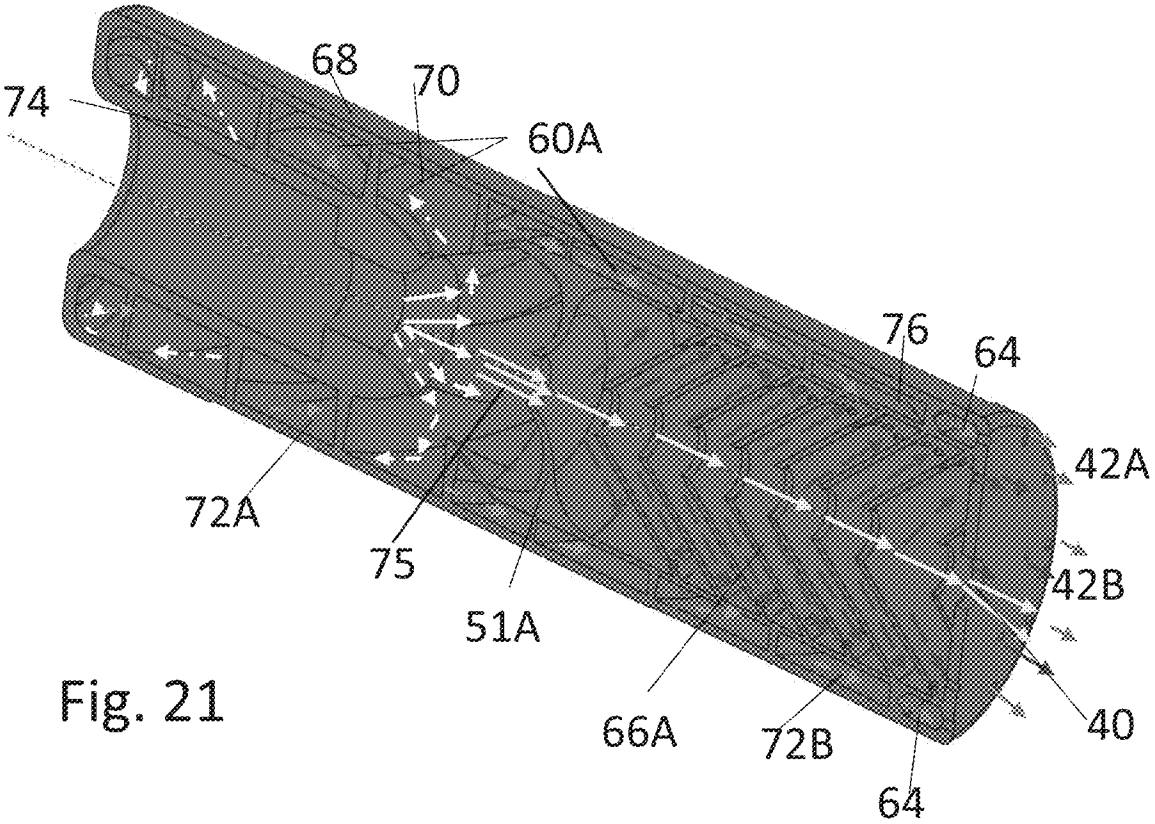
FIG. 21 is a perspective cutaway view of the suppressor of FIG. 19 with the can in accordance with aspects of the disclosure.

As shown in FIG. 21, the distance between the first portion 74 and the can 68 is larger than the distance between the second portion 76 and the can 68. Thus, the radial length of the channels 70/72A is larger than the radial length of channel 72B. This enables of substantial portion of the diverted gases to flow through channels 70/72A to reduce the backpressure and at the same time not increase the longitudinal length of the suppressor 100A and weight.

Figure 23:
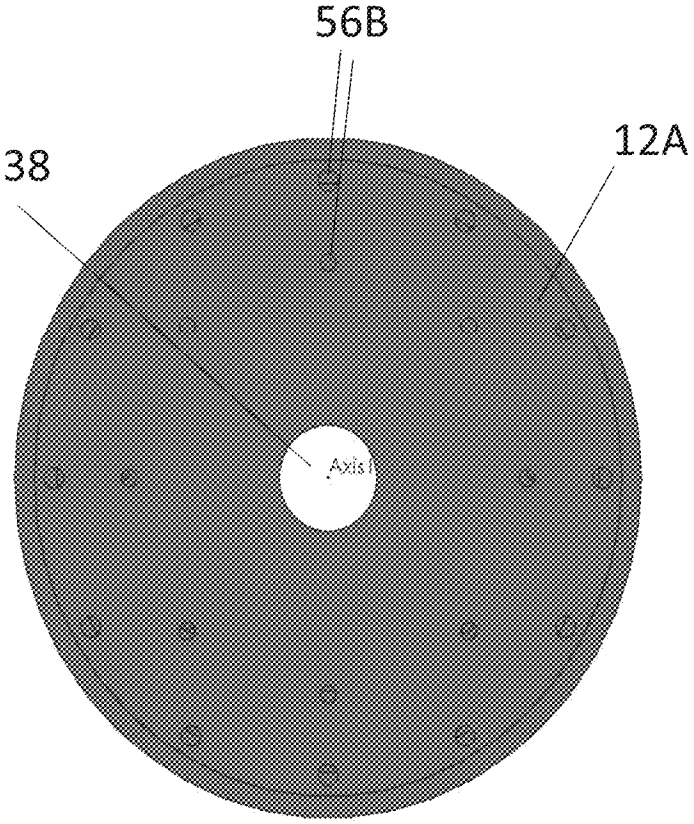
FIG. 23 is an end view from the distal end of the suppressor of FIG. 19 in accordance with aspects of the disclosure.
Figure 24:
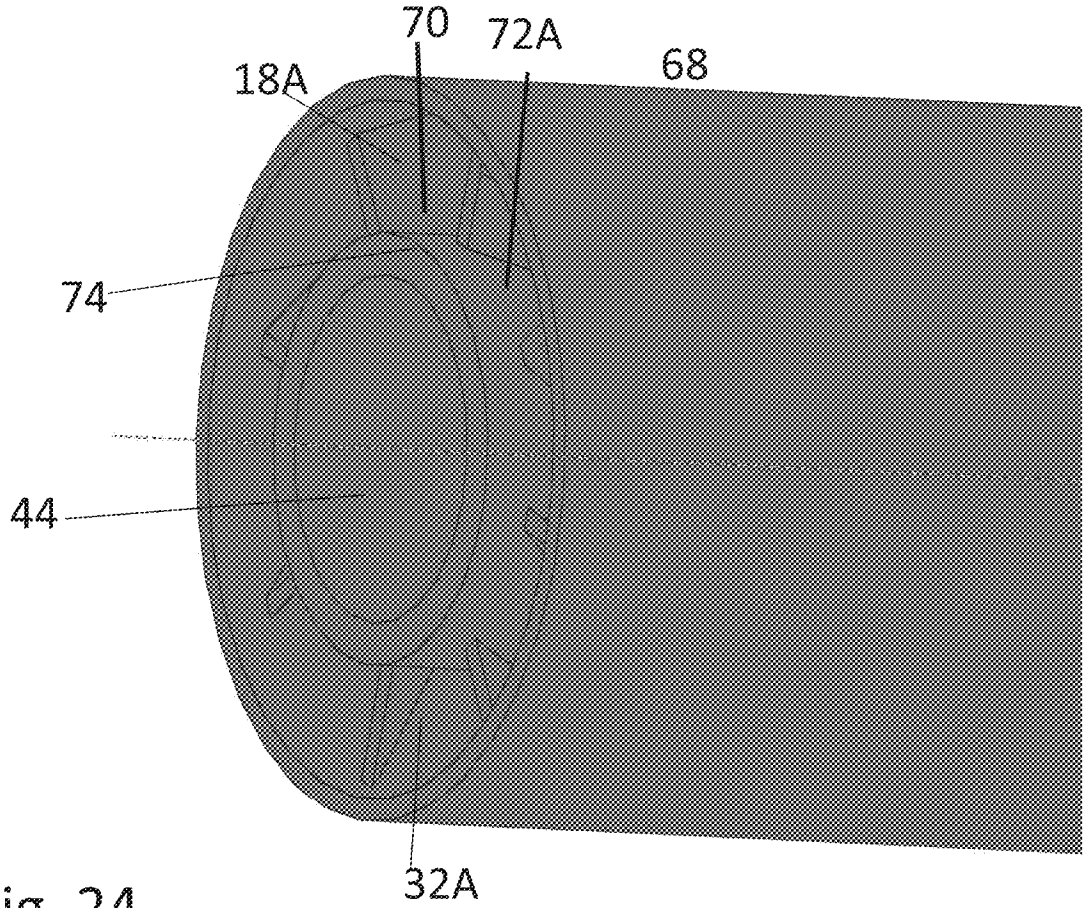
FIG. 24 is a perspective view of the proximal end of the suppressor of FIG. 19 in accordance with aspects of the disclosure with the proximal end wall removed.

The distal end wall 12A has a main exit 38 as shown in FIG. 23 (end view). The diameter of the main exit 38 is based on the type of projectile. In accordance with aspects of the disclosure, the distal end wall 12A further comprises a plurality of vents 56B. As shown in FIG. 23, there are two sets of vents 56B. One set in communication with the diverted gas flow from the third chamber 64 and another set in communication with the diverted gas flow from the fourth chamber 66A. One set is radially inward from the other.

The vents 56B are configured to allow the diverted gases to escape the suppressor 100A in the form of a slip stream 42A and 42B as shown in FIGS. 19 and 21. As shown in FIG. 23, the vents 56B are circular. One set of the vents 56B may be aligned in the longitudinal direction with the vents 58 in the annular rib 16. However, the vents 58 also may be offset.

As with vents 58 (in the annular rib 16), the shape, size and number of the vents 56B in the distal end wall 12A may vary depending on the type of firearm and projectile and the desired performance of the suppressor.

The third chamber 64 is similar to the third chamber in suppressor 100 and will not be described again in detail.

The suppressor 100A further comprises non-linear wall 51A. The non-linear wall 51A is shown in at least FIGS. 20, 21, 25 and 26. The function of the non-linear wall 51A is similar to the function of non-linear wall 51 as described above, which is to divert gases toward the openings 22A.

The non-linear wall 51A is disposed downstream of the openings 22A. The non-linear wall 51A extends inward from the inside surface (not labeled) of the outer wall 36A. The non-linear wall 51A as a central opening (not labeled). The central opening is aligned with the main exit 38 and the main projectile path. The central opening is configured to allow the projectile to pass there through. The non-linear wall 51A is shaped to smoothly guide the expanded and diverted gases toward the first openings 22A. As shown, the shape of the non-linear wall 51A is different from the shape of the non-linear wall 51. The shape of the non-linear wall 51 is designed using CFD and optimized in combination with the other elements of the suppressor for performance criteria discussed herein. However, in other aspects of the disclosure, the shapes may be the same.

Figure 26:
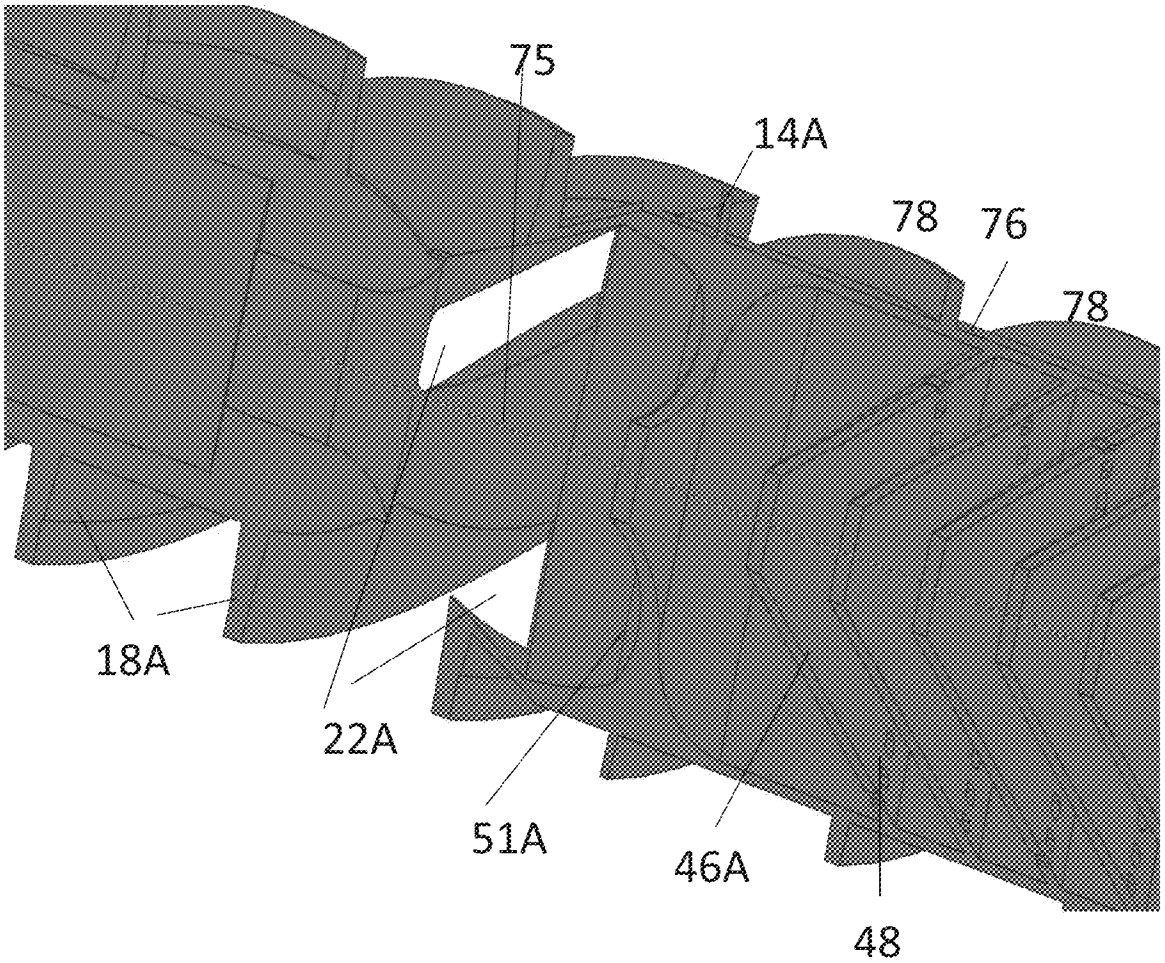
FIG. 26 is a cutaway perspective view of a portion of the suppressor of FIG. 19 in accordance with aspects of the disclosure, showing part of the first chamber and fourth chamber, with the can removed.
Figure 27:
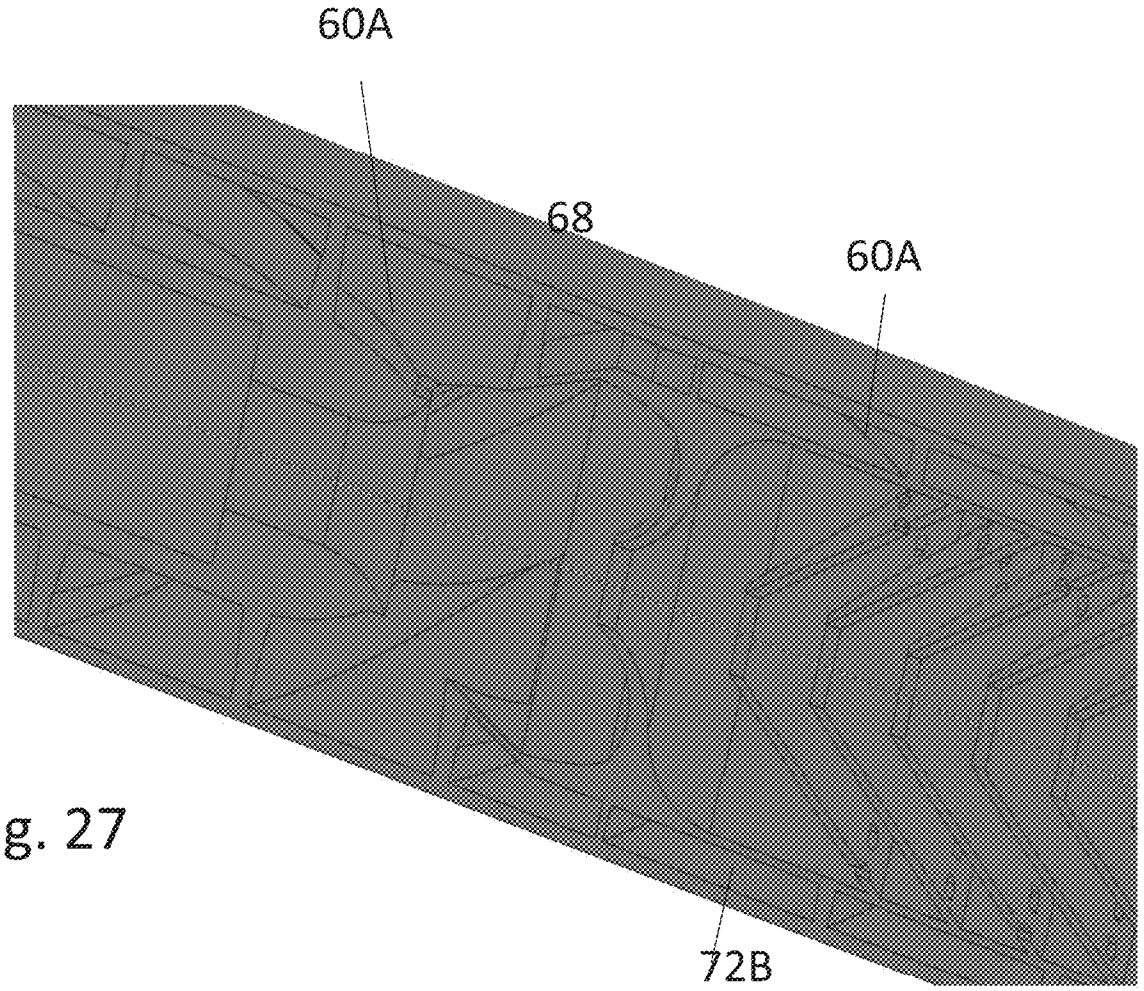
FIG. 27 is the same view as FIG. 26 with the can.
Figure 28:
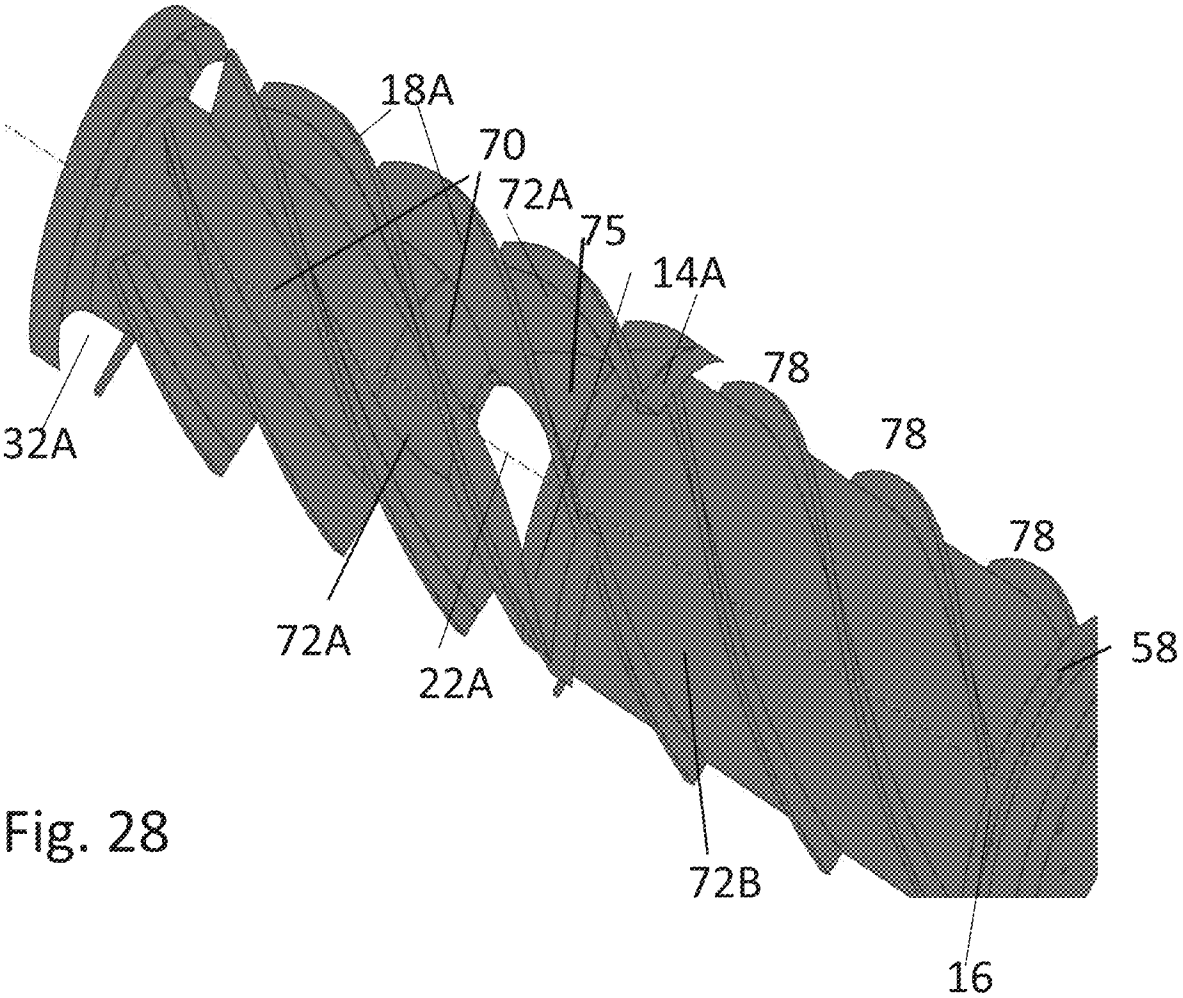
FIG. 28 is a perspective view of part of the suppressor of FIG. 19 in accordance with aspects of the disclosure, showing a part of the first chamber and the segmented barrier rib.

The suppressor 100A further comprises a plurality of baffles 46A as shown in at least FIGS. 20 and 26. Like, the non-linear wall 51A, each baffle 46A also has a central opening. All of the openings are aligned with the main exit 38.

Each baffle 46A is shaped to divert gases from the projectile path toward the outer wall 36A. As shown, each baffle 46A has slits 48 for moving the diverted gases therebetween. The slits 48 are shown in at least FIGS. 20 and 26. As depicted, the shape of baffle 46A is different from the shape of baffle 46. Similar to the shape of the non-linear wall, the shape of the baffles is designed using CFD and optimized in combination with other elements of the suppressor for performance criteria discussed herein. However, in other aspects of the disclosure, the shapes may be the same.

The number of slits, size and shape of the slits may vary depending on the type of firearm and projectile and the desired performance of the suppressor.

As depicted, there are eight baffles 46A. However, in other aspects of the disclosure, the number of baffles 46A may be different. In an aspect of the disclosure, the spacing between each baffle 46A is the same. However, in other aspects of the disclosure, the spacing between baffles 46A may be different. As depicted, in at least FIGS. 20 and 26, the spacing between baffles 46A in the longitudinal direction is smaller than the spacing between baffles 46 of suppressor 100.

Flow of the diverted gases within the suppressor 100A will now be described in detailed with reference to FIGS. 19 and 21 (and certain partial views of the suppressor 100A). Diverted gas flow in the first chamber 60A is shown in the figures with dashed and dotted lines. Diverted gas flow in the third chamber 64 is shown in the figures with doted lines with multiple dots. Diverted gas flow in the fourth chamber 66A is shown in the figures with dashed lines with long dashes. Gas flowing in the projectile gas (that is not diverted) is shown with solid lines. This gas exits the main exit 38 as the main gas flow 40. Gas exiting the third chamber 64 via vents 56B is the slip stream 42A and gas exiting the fourth chamber 66A via vents 56B is the slip stream 42B.

When a projectile is discharged from a firearm 150 into the suppressor 100A, the projectile progresses through the projectile path towards the main exit 38. In concert with this progression, gases (such as pressure gases) pass through the same. However, some of the gases are diverted into the various chambers by components of the suppressor 100A. As shown in FIG. 21, some of the gases are guided by the third portion 75 and the shape of the non-linear wall 51A toward the openings 22A (see, e.g., FIG. 19). The gases then enter the channels 70 and flow (in a spiral pattern) toward the proximal end 102 of the suppressor 100A. The segments of the segmented barrier rib 14A block the diverted (and expanded gases) from flowing further toward the distal end 104.

Once the diverted gases reach the edge of the ribs 18A (start of the gap 32A), the gases will change direction and enter channels 72A as shown in FIGS. 19 and 21. As shown in at least FIGS. 20 and 25, the proximal end wall 10 has a curved inner surface 52 which allows the gases to smoothly flow between channels 70/72A.

Figure 25:
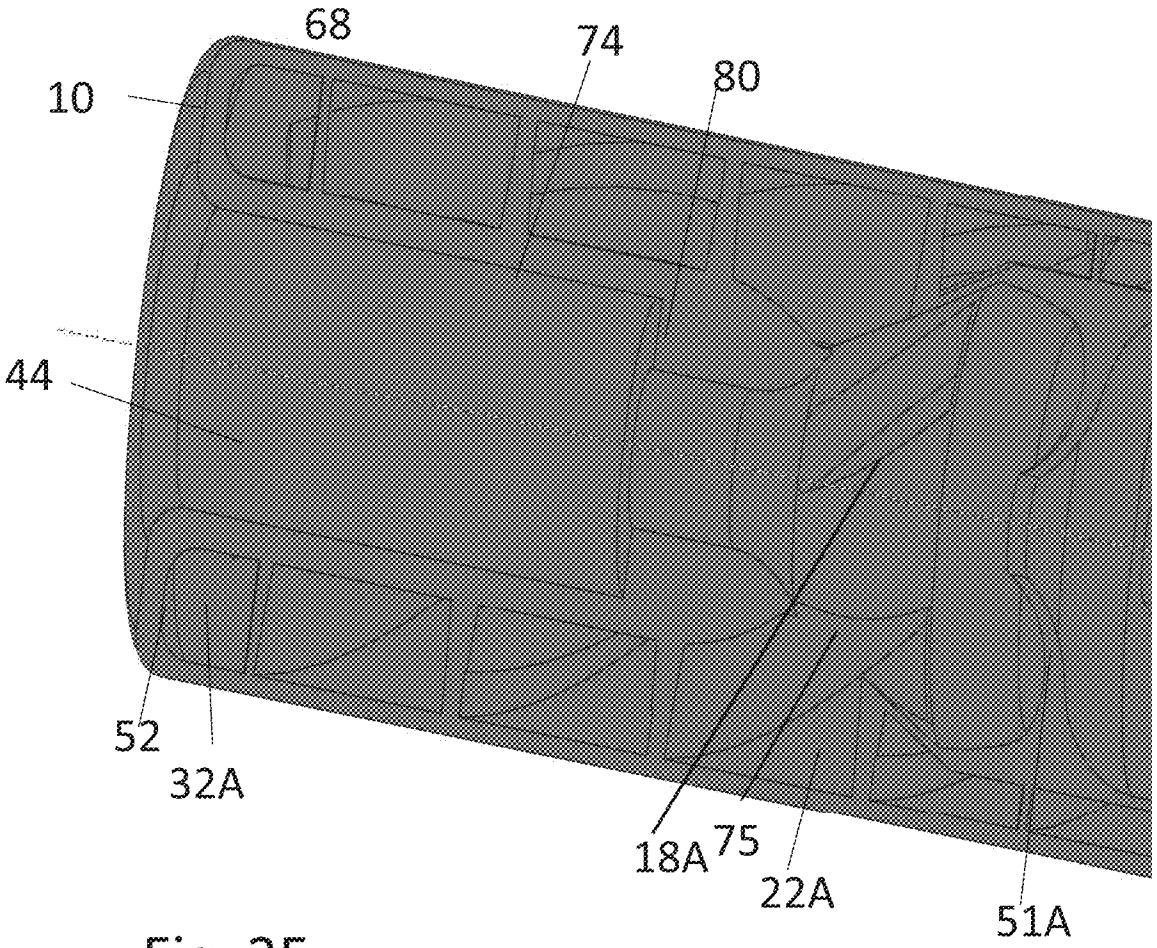
FIG. 25 is a cutaway view of part of the first chamber of the suppressor of FIG. 19 in accordance with aspects of the disclosure.

FIG. 25 is a partial view showing a part of the first chamber 60A (proximal end part). The first chamber 60A path is continuous and includes the channels 70, annular gap 32A and channels 72A and 72B (also shown in FIG. 27).

Once the gases reach the annular rib 16, the gases will transfer from the first chamber 60A to the third chamber 64 via vents 58 (see, e.g., FIG. 21).

The gases will escape the suppressor 100A via one set of the vents 56B as the slip stream 42A.

The gases that were not diverted into the first and third chambers 60A and 64, and remain in the projectile path, may be diverted (expand) into the fourth chamber 66A as the projectile continues toward the main exit 38. As shown in FIG. 21, the gases may be diverted by each baffle 46A (expand) into respective areas (toward the outer wall 36A). The diverted gases also travels between the baffles 46A. These gases will exit the suppressor via one set of vents 56B as the slip stream 42B.

Gases not diverted will exit the main exit 38 as the main gas flow 40.

The chambers 60A, 64 and 66A provide a volume for the diverted gases to expand, thus, reduces the pressure of the gas 40 which exits main exit 38. Additionally, the chambers 60A, 64, and 66A increase the time that the gases are within the suppressor 100A thus ensuring a more complete burn of the explosive charge generating the gases, thus reducing blast and flash. The increase in time also reduces the energy flow rate. However, the increase in time is countered by the venting 56B in the distal end wall 12A (and vents 58). The vents reduce the amount of heat absorbed by the suppressor 100A.

The gases exiting the vents 56B form slip streams 42A and 42B around the gases 40 that exits the main exit 38. The slip streams minimize a mushroom of gases (with would otherwise occur) and any gases entrained are previously burnt gases, and thus minimize the conditions for secondary ignition. With the disclosed suppressor 100A, the slip streams 42A and 42B will mix with gases 40 exiting the main exit 38 and the mixture will not combust due to insufficient oxygen.

The slip streams 42A and 42B also create destructive interference with the sound emitted as the gas 40 exits the main exit 38. This is achieved by controlling the timing the slip steams 42A and 42B exits the vent 56B. As described above, the number of vents 56B, 58 (size and shape) may be set based on performance, and the pitch of the ribs 18A, 78 may be set to control the timing that the slip stream 42A exits the vents 56B. Additionally, the number of slits 48 in each baffle 46A and shape and size may be adjusted to control the timing of the slip stream 42B exits the vents 56B.

FIG. 41 illustrates a table 1000 shown acoustic wave shaping by changing the diameter of the outer vents (a subset of vents 56B) for the suppressor 100A. As can be seen, different vent sizes (diameters) affects the sound, e.g. simulated max pressure at different external locations. The locations are 90° from the distal end of the suppressor and 170° from the distal end. 90° is perpendicular to the suppressor and 170° is the approximate location of a person's ear.

As shown in the table 1000, a vent diameter of 0.055 inches has the lowest sound at the two locations (of the three diameters: DiaA, DiaB and DiaC), whereas the vent diameter of 0.045 has the highest sound at the two locations (of the three diameter). The results are made of CFD simulations. However, the results of CFD simulations correlate with a suppressor made in accordance with the designs. In other words, the direction of change for the different diameters correlate and is a reason why the model may be used to optimize the designs described herein prior to construction.

Therefore, table 1000 demonstrates that acoustic wave shaping, e.g., controlled destructive interference may be achieved by changing the vent diameter for vent 56B (outer vent) for the suppressor. The acoustic wave shaping equally applies to the other suppressor designs. Similar acoustic wave shaping may also be achieved by changing the diameter of the inner vents on the distal end wall 12A as well.

The pitch and vents configurations are also set based on the type of firearm 150 and projectile.

Moreover, the chambers 60A, 64 and 66A reduce the formation of mach disc as the gases 40 exit the main exit 38. This is because the speed (pressure) is reduced. This also reduces a potential for secondary ignition or a flash.

The suppressor 100A will typically weigh less than suppressor 100 and will have a shorter longitudinal length.

FIGS. 30-40 show another example of a suppressor 100B in accordance with aspects of the disclosure. In FIGS. 30-40 like parts between the suppressors 100B, 100A and 100 have the same label. Like parts will not be described again in detail. The following description focuses on the differences between the suppressors 100B, 100A and 100.

Figure 31:
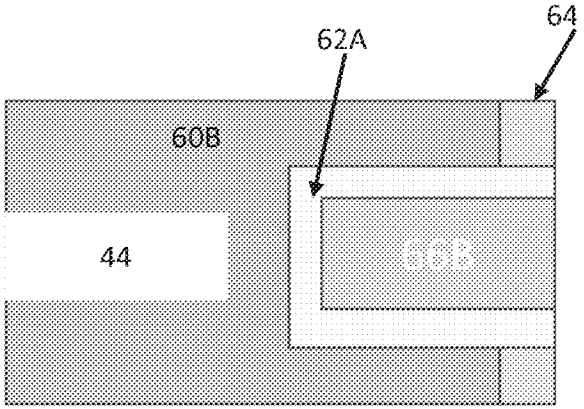
FIG. 31 is a drawing of the suppressor in FIG. 30 in accordance with aspects of the disclosure showing relative locations of gas expansion chambers.

The suppressor 100B is similar to suppressor 100A in that the first chamber 60B has a similar footprint as first chamber 60A, extending from the proximal end wall 10 to the annular rib 16 (see, e.g., FIG. 31). However, in an aspect of the disclosure, the first portion 74 in suppressor 100B may be longer in the longitudinal direction than the first portion in suppressor 100A. Additionally, ribs 78A may not extend to the segmented barrier rib 14A (see, e.g., FIG. 32). As shown in at least FIG. 32, there is a gap between the segmented barrier rib 14A and the ribs 78A. The ribs 78A define channels 72C for the diverted gases to toward to the third chamber 64.

The third chamber 64 is the same as the third chamber in both the suppressors 100 and 100A. Unlike, suppressor 100A, the suppressor 100B has a second chamber 62A. The second chamber 62A surrounds the fourth chamber 66B.

A portion of the second chamber is defined by the second portion 76 (of the outer wall 36A) and an inner wall 88. The inner wall 88 extends from an inner surface of the distal end wall 12B. The inner wall 88 extends longitudinally toward the proximal end 102. In an aspect of the disclosure, the inner wall 88 may end in the same longitudinal position where the ribs 78A began as shown in at least FIGS. 33, 34 and 37-40.

A plurality of ribs 86 extend from the outer surface of the inner wall 88 to the inner surface of the second portion 76 (of the outer wall 36A). The ribs 86 extend from the proximal end of the inner wall toward the distal end 104. As with the other ribs (for channels), the ribs 86 may extend in a straight line. In other aspects of the disclosure, as shown in at least FIGS. 38 and 39, the ribs 86 may extend in a spiral arrangement. The distance between each adjacent ribs 86 may be constant. In other aspects of the disclosure, the distance between adjacent ribs 86 may be different. The distance between ribs 86 and number thereof may be selected to control the timing of the slip stream 42B exiting the vents 56C of the distal end wall 12B. The adjacent ribs 86 define a space or channel 82 for diverted gases (which have expanded) to flow.

Figure 33:
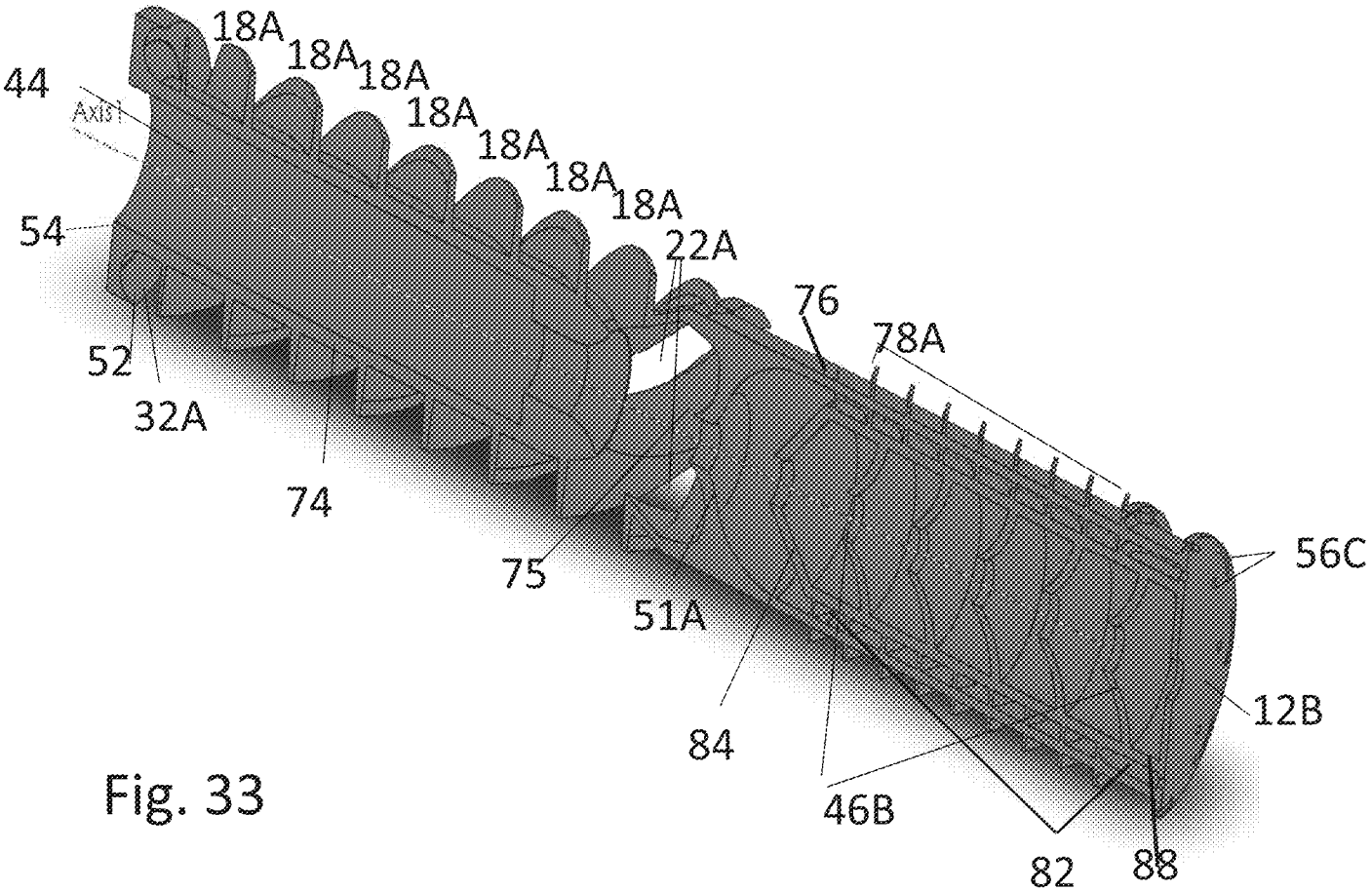
FIG. 33 is a perspective cutaway view of the suppressor of FIG. 32 without the can in accordance with aspects of the disclosure.
Figure 37:
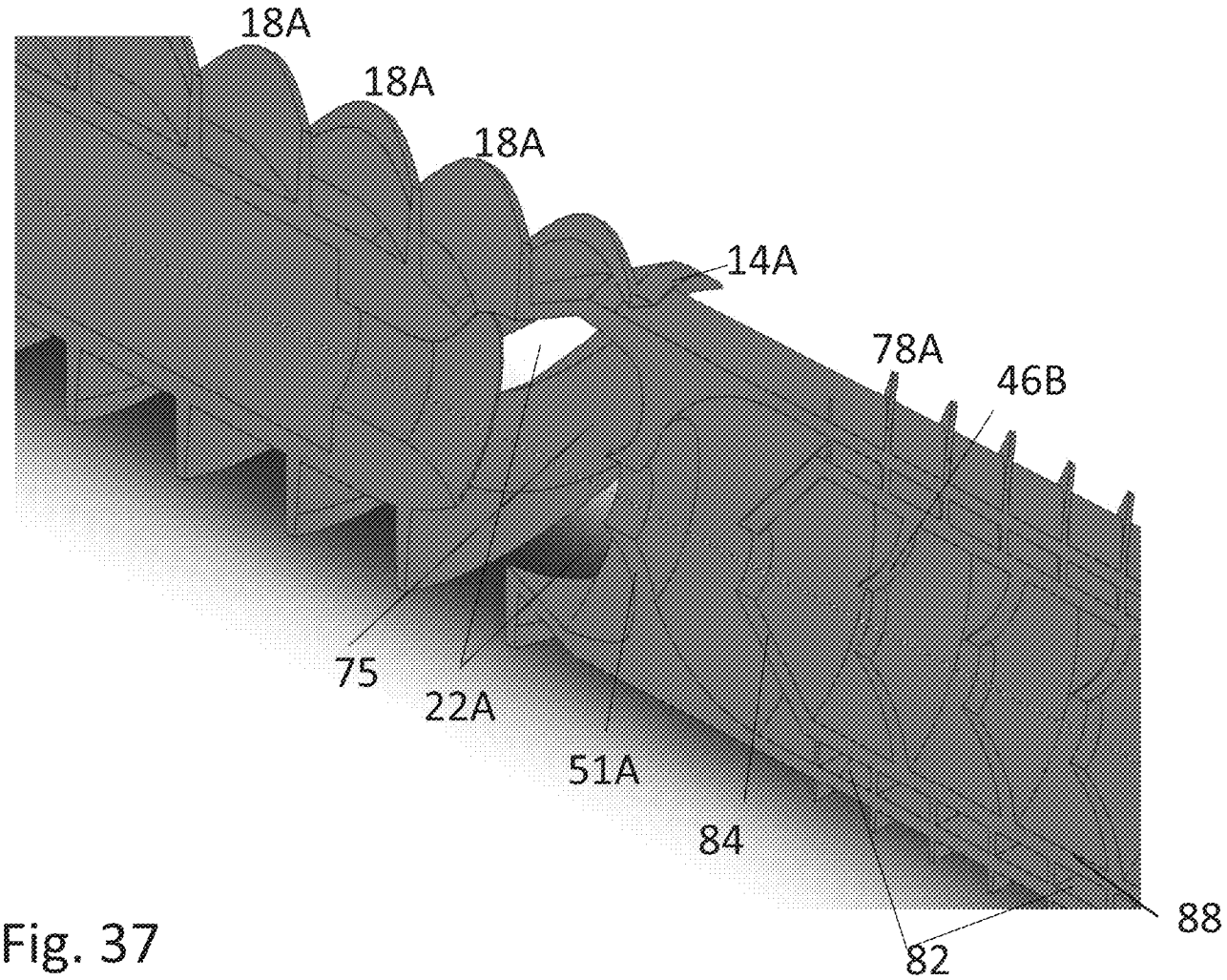
FIG. 37 is a cutaway perspective view of a portion of the suppressor of FIG. 32 in accordance with aspects of the disclosure, showing part of the first, second and fourth chambers, with the can removed.
Figure 38:
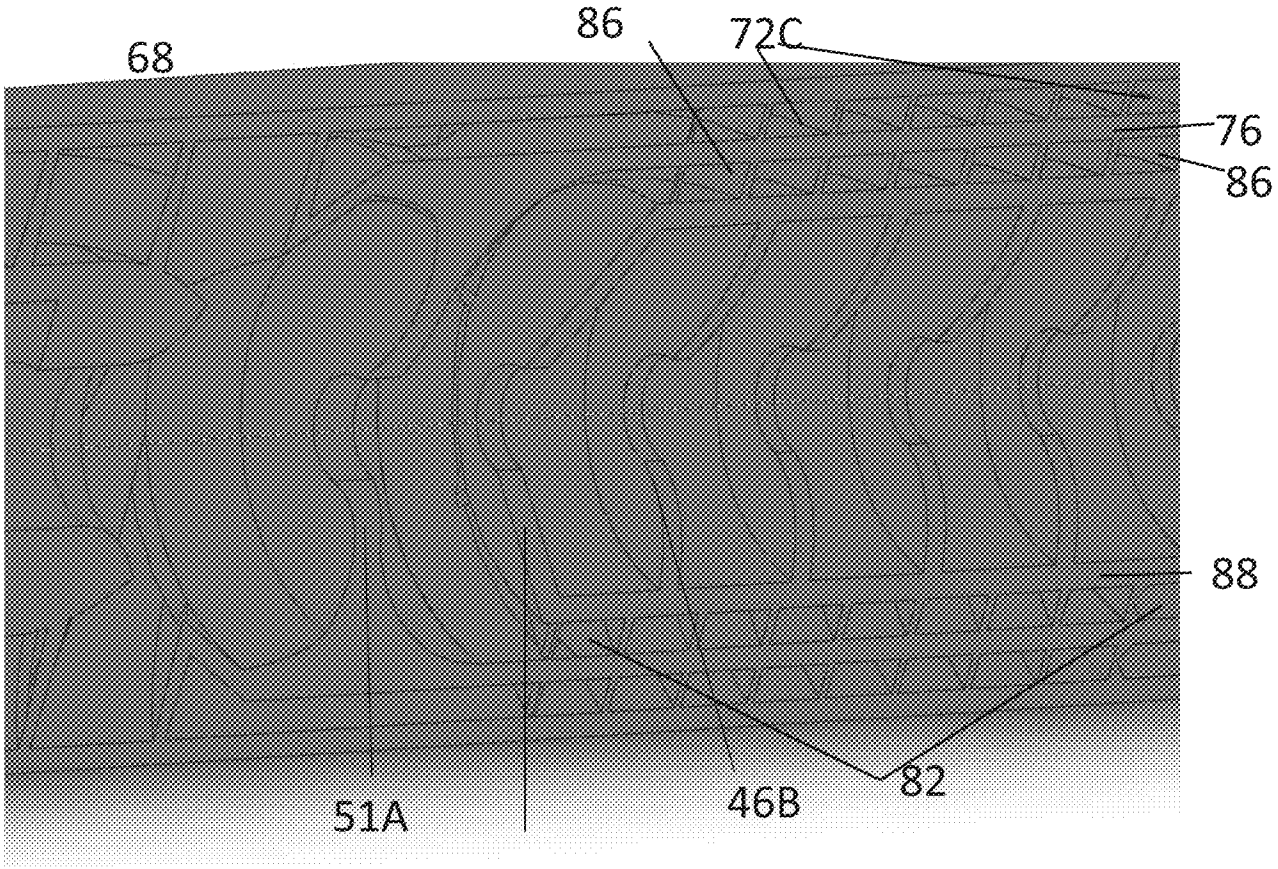
FIG. 38 is a cutaway perspective view of a portion of the suppressor of FIG. 32 in accordance with aspects of the disclosure, showing part of the first, second and fourth chambers, with the can.
Figure 39:
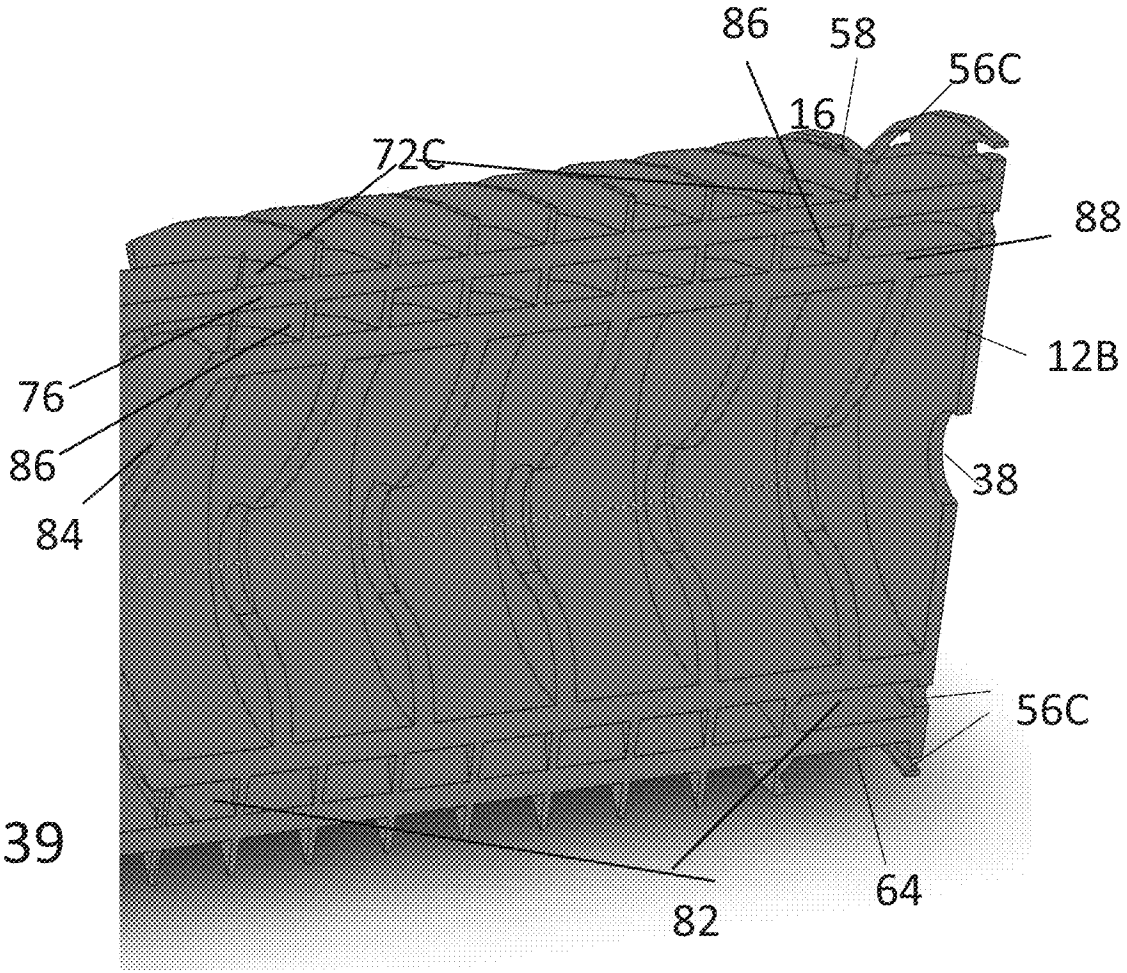
FIG. 39 is a cutaway perspective view of a portion of the suppressor of FIG. 32 in accordance with aspects of the disclosure, showing a distal portion of the suppressor with the can removed.
Figure 40:
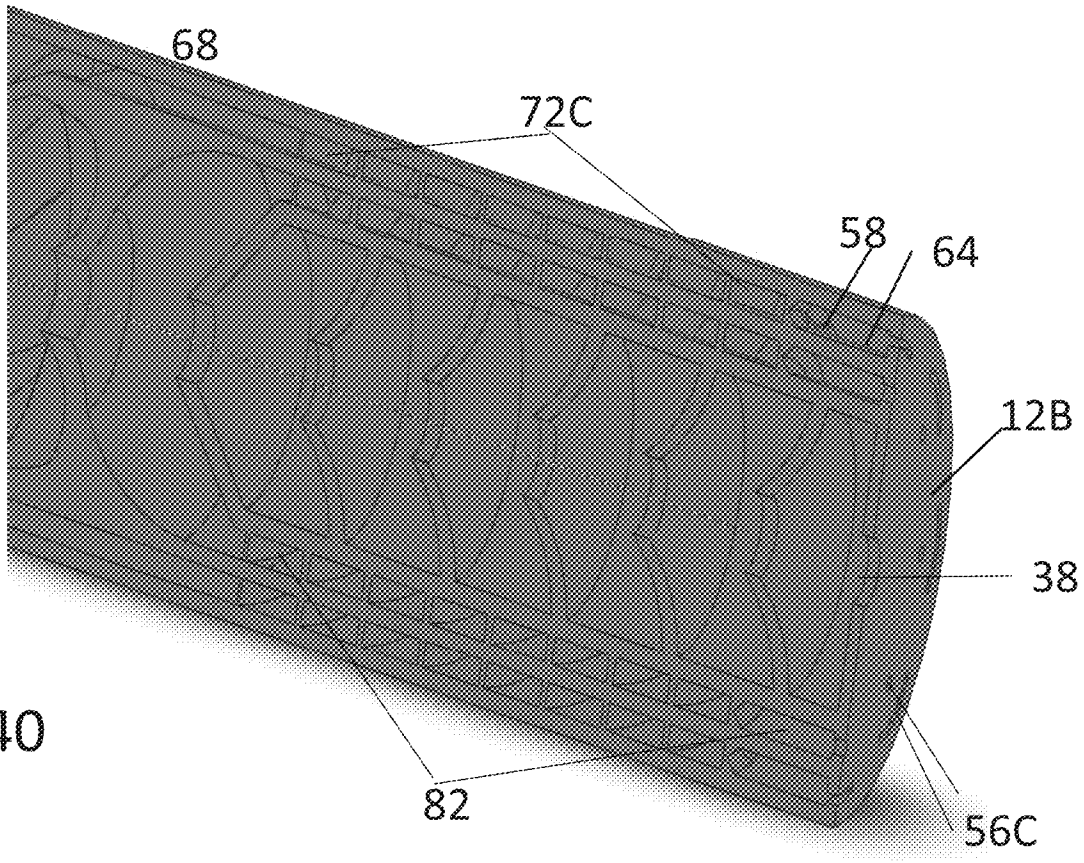
FIG. 40 is a cutaway perspective view of a portion of the suppressor of FIG. 32 in accordance with aspects of the disclosure, showing a distal portion of the suppressor with the can.

The suppressor 100B comprises a diverting wall 84 (see, e.g., FIGS. 33, 37 and 38). The diverting wall 84 is disposed downstream of the non-linear wall 51A and upstream of the baffles 46B. The diverting wall 84 also has a central opening which is aligned with the central opening in the non-linear wall 51A and the main exit 38. The diverting wall 84 is configured to divert gases from the projectile path toward the channels 82 in the second chamber 62A. The diverting wall 84 is shapes to smoothly guide the gases to the channels 82. For example, the diverting wall 84 as shown in at least FIGS. 33, 37 and 38 has an angled surface toward the channels 82.

Figure 36:
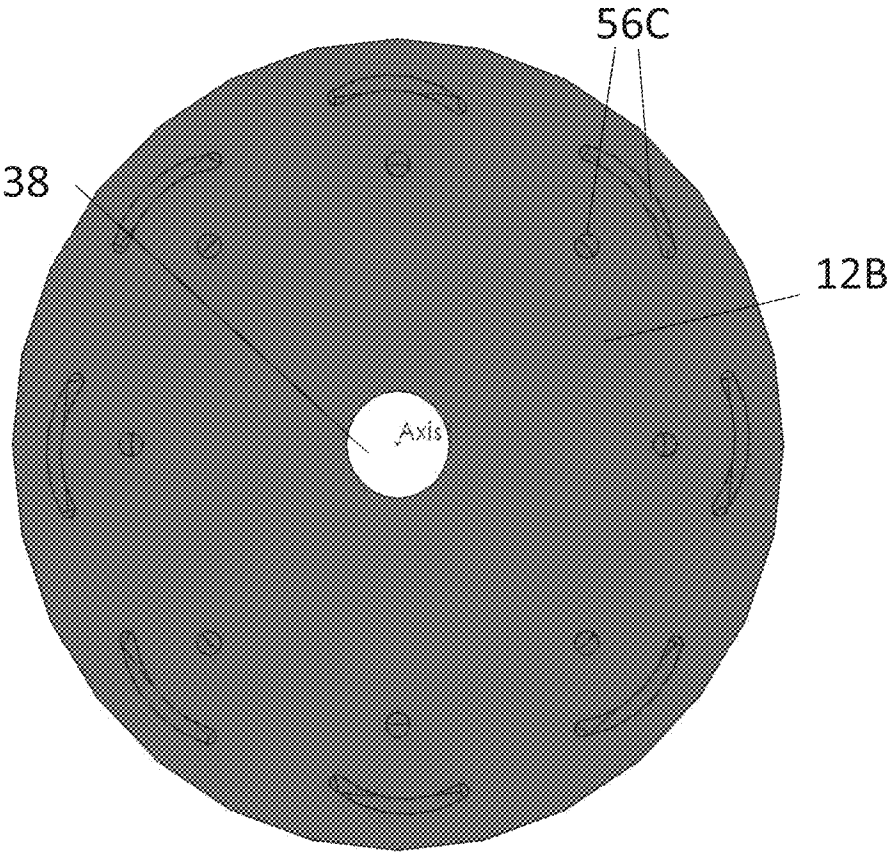
FIG. 36 is an end view from the distal end of FIG. 32 in accordance with aspects of the disclosure.

The distal end wall 12B has a main exit 38 as shown in FIG. 36 (end view). The diameter of the main exit 38 is based on the type of projectile. In accordance with aspects of the disclosure, the distal end wall 12B further comprises a plurality of vents 56C. As shown in FIG. 36, there are two sets of vents 56C. One set in communication with the diverted gas flow from the third chamber 64 and another set in communication with the diverted gas flow from the second chamber 62A. The set in communication with the second chamber 62A is radially inward from the other set in communication with the third chamber 64.

Figure 32:
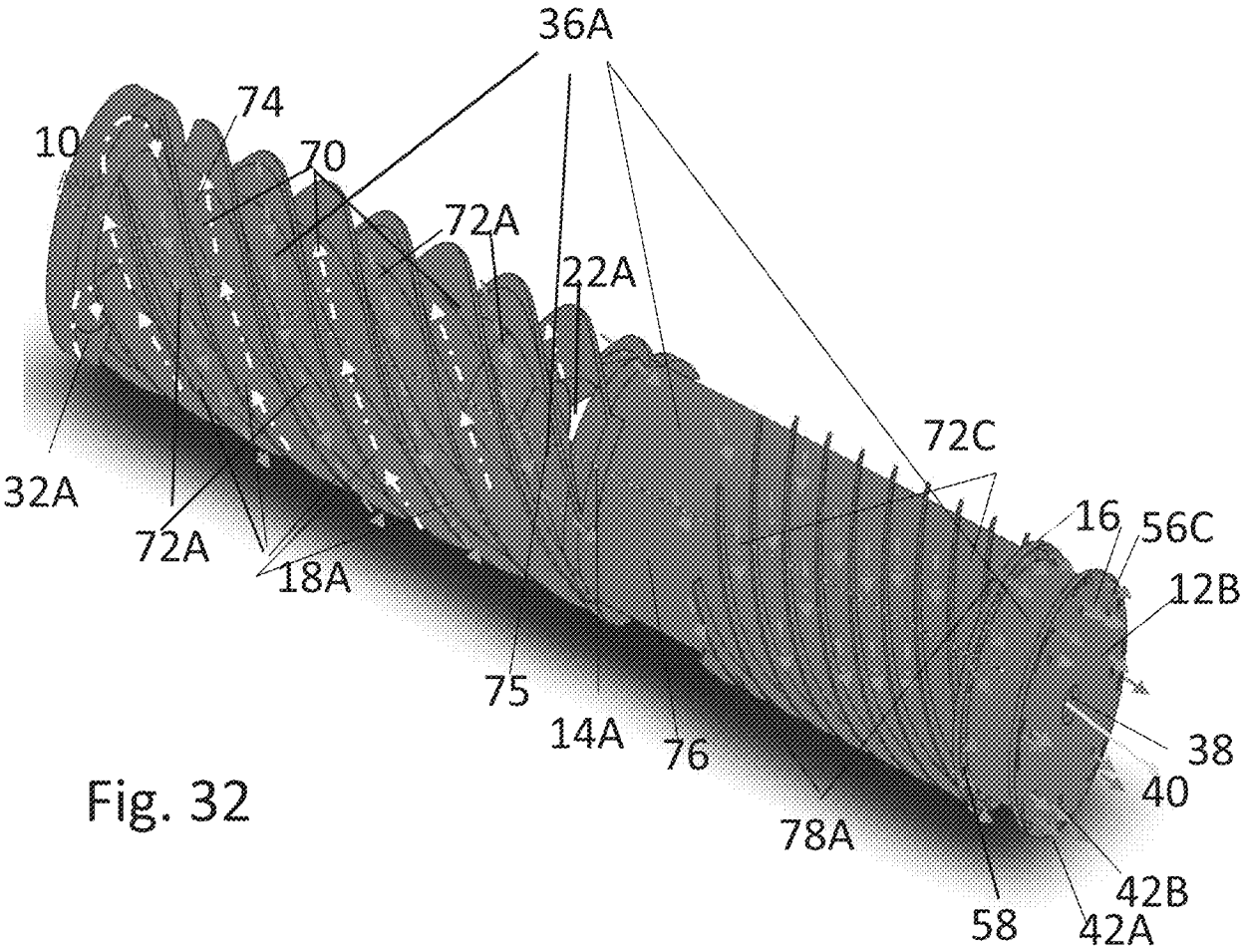
FIG. 32 is a perspective view of the suppressor of FIG. 30 without a can in accordance with aspects of the disclosure.
Figure 34:
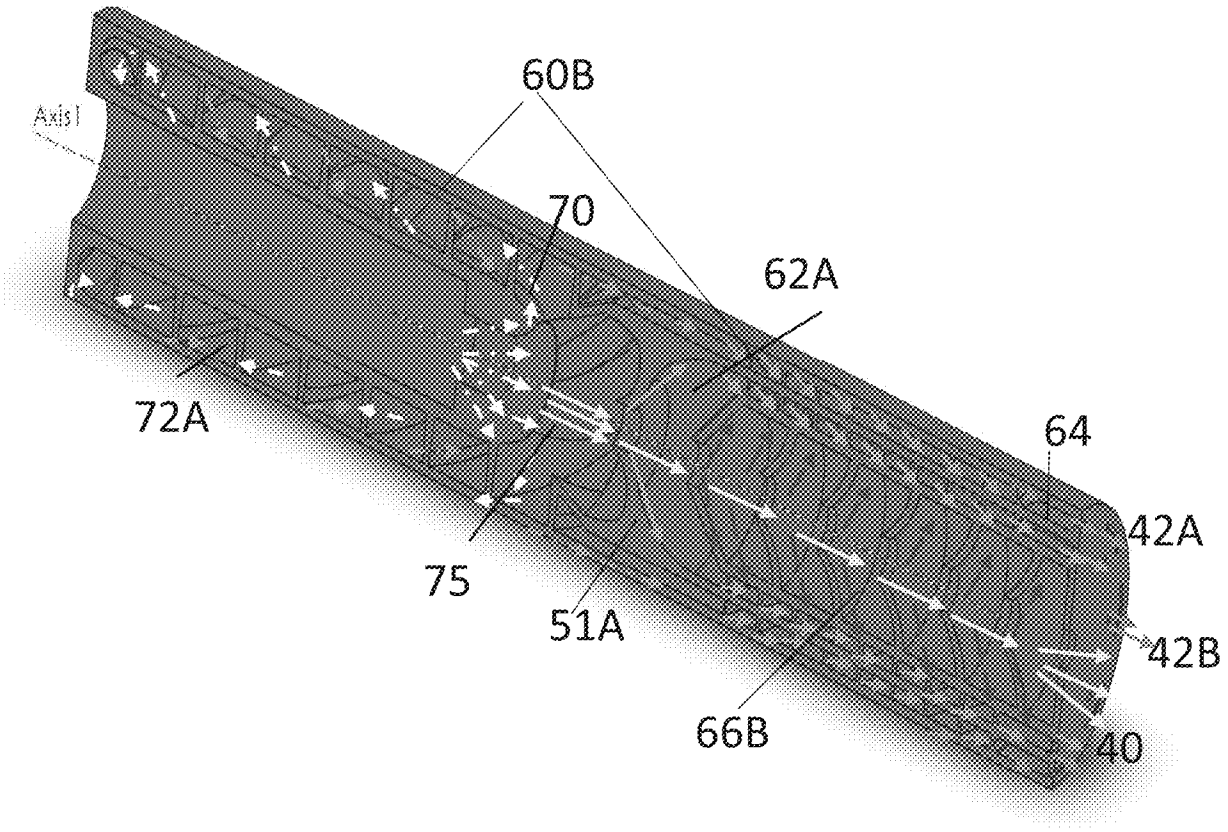
FIG. 34 is a perspective cutaway view of the suppressor of FIG. 32 with the can in accordance with aspects of the disclosure.
Figure 35:
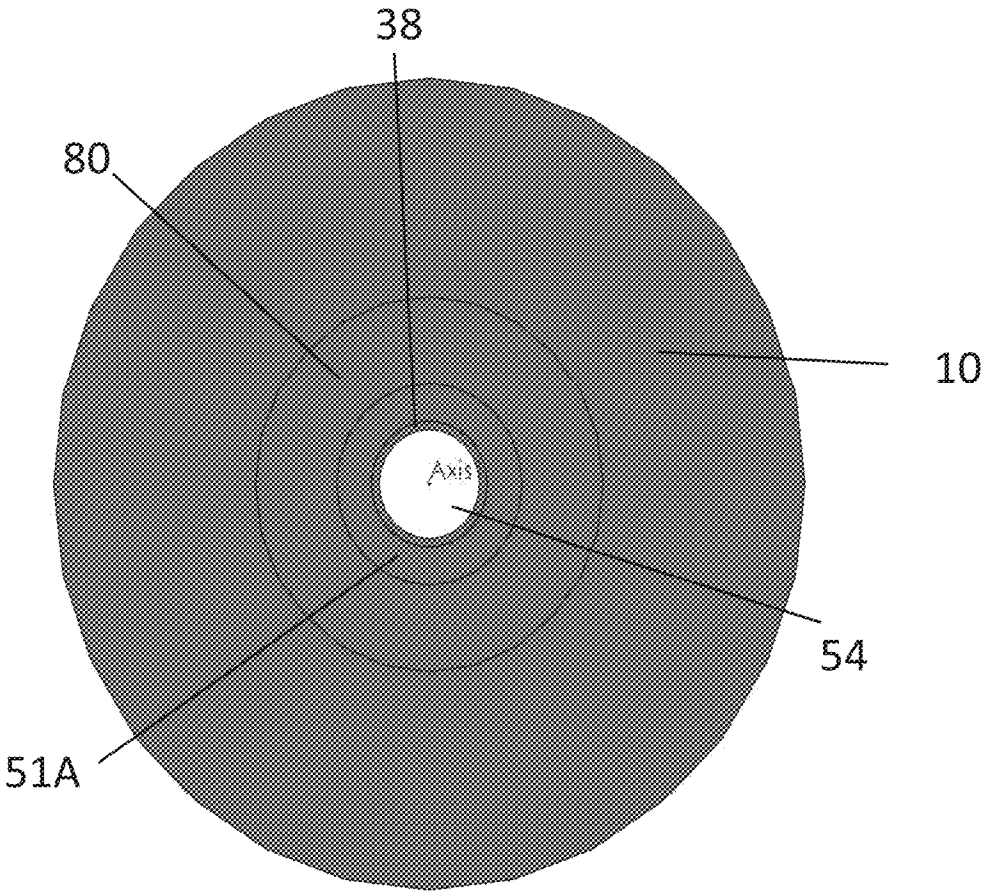
FIG. 35 is an end view from the proximal end of the suppressor of FIG. 32 in accordance with aspects of the disclosure.

The vents 56C are configured to allow the diverted gases to escape the suppressor 100B in the form of slip streams 42A and 42B as shown in FIGS. 32 and 34. As shown in FIG. 36, the vents 56C have both a slit shape and circular shape, respectively. The vents in communication with the third chamber 64 are slits and the vents in communication with the second chamber 62A are circular. Although, the outer vents and inner vents are shown to have different shapes, in other aspects of the disclosure, the shapes may be the same. In other aspects of the disclosure, the venting shapes may be reversed.

One set of the vents 56C may be aligned in the longitudinal direction with the vents 58 in the annular rib 16. However, the vents 58 also may be offset.

As with vents 58 (in the annular rib 16), the shape, size and number of the vents 56C in the distal end wall 12B may vary depending on the type of firearm and projectile and the desired performance of the suppressor.

In other aspects of the disclosure, additional vents may be included in the distal end wall 12B in communication with the fourth chamber 66B.

The suppressor 100B has a fourth chamber 66B. The fourth chamber 66B comprises a plurality of baffles 46B (see, e.g., FIG. 33). As shown in FIG. 33, the fourth chamber 66B has five baffles 46B. However, the number of baffles 46B may be different. The fourth chamber 66B is longer in the longitudinal direction than the fourth chamber 66A in suppressor 100A and the spacing between each baffle 46B is larger. Each baffle 46B is configured to divert gases flowing in the projectile path toward the inner wall 88.

As depicted, the baffles 46B do not have slits. However, in other aspects of the disclosure, each baffle 46 may have slits 48 such that diverted gases may travel between baffles. As depicted, the shape of baffle 46B has a similar shape as the shape of baffle 46.

The flow of the diverted gases within the suppressor 100B is similar as the flow of the diverted gases within suppressor 100A except the gases may also flow within the second chamber 62A which is around the fourth chamber 66B and there is a space between the segmented barrier rib 14A and ribs 78A. The flow will now be described in detailed with reference to FIGS. 32 and 34 (and certain partial views of the suppressor 100B). Diverted gas flow in the first chamber 60B is shown in the figures with dashed lines having a short dash (and a dot). Diverted gas flow in the second chamber 62A is shown in the figures with lines. Diverted gas flow in the third chamber 64 is shown in the figures with doted lines with multiple dots. Diverted gas flow in the fourth chamber 66B is shown in the figures with dashed lines with long dashes. Gas flowing in the projectile gas (that is not diverted) is shown with solid lines. This gas exits the main exit 38 as the main gas flow 40. Gas exiting the third chamber 64 via vents 56C is slip stream 42A and gas exiting the second chamber 62A via vents 56C is slip stream 42B.

When a projectile is discharged from a firearm 150 into the suppressor 100B, the projectile progresses through the projectile path towards the main exit 38. In concert with this progression, gases (such as pressure gases) pass through the same. However, some of the gases are diverted into the various chambers by components of the suppressor 100B. As shown in FIG. 34, some of the gases are guided by the third portion 75 and the shape of the non-linear wall 51A toward the openings 22A (see, e.g., FIG. 32). The gases then enter the channels 70 and flow (in a spiral pattern) toward the proximal end 102 of the suppressor 100B. The segments of the segmented barrier rib 14A block the diverted (and expanded gases) from flowing further toward the distal end 104.

Once the diverted gases reach the edge of the ribs 18A (start of the gap 32A), the gases will change direction and enter channels 72A as shown in FIGS. 32 and 34. As shown in at least FIG. 33, the proximal end wall 10 has a curved inner surface 52 which allows the gases to smoothly flow between channels 70/72A. The gases will travel toward the distal end via channels 72A. Once the diverted gases pass the segmented barrier rib 14A, since there are no ribs, the gases will expand to fill the chamber in this portion as shown in FIG. 32. The diverted gases will then flow into the channels 72C. Once the gases reach the annular rib 16, the gases will transfer from the first chamber 60A to the third chamber 64 via vents 58 (see, e.g., FIG. 34).

Since the pitch of the ribs 78A is greater than the pitch of ribs 78 (ribs are closer) and the spiral path is tighter, the time that it takes to get to the third chamber 64 is longer than in the suppressor 100A (also the length in the longitudinal direction is longer).

The gases will escape the suppressor 100B via one set of the vents 56C as the slip stream 42A.

The gases that were not diverted into the first and third chambers 60B and 64, and remain in the projectile path, may be diverted (expand) into the second chamber 62A and fourth chamber 66B.

The diverted gases will flow toward the distal end 104 in the channels 82 of the second chamber 62A, e.g., between the ribs 86 as shown in FIGS. 32 and 34. The diverted gas flowing through channels 82 will escape the suppressor 100B via one of the sets of vents 56C as the slip stream 42B. The pitch of ribs 86 may be the similar as the pitch of ribs 78A. Having a similar pitch may allow the gases exiting the vents 56C as slip streams 42A and 42B to exit at similar timings.

In the fourth chamber 66B, the gases may be diverted by each baffle 46B (expand) into respective areas (toward the inner wall 88).

The chambers 60B, 62A, 64 and 66B provide a volume for the diverted gases to expand, thus, reduces the pressure of the gases 40 which exits the main exit 38. Additionally, the chambers 60B, 62, 64, and 66B increase the time that the gases are within the suppressor 100B thus ensuring a more complete burn of the explosive charge generating the gases, thus reducing blast and flash. The increase in time also reduces the energy flow rate. However, the increase in time is countered by the venting 56C in the distal end wall 12B (and vents 58). The vents reduce the amount of heat absorbed by the suppressor 100B.

The gases exiting the vents 56C form slip streams 42A and 42B around the gases 40 that exits the main exit 38. The slip stream minimizes a mushroom of gases (with would otherwise occur) and any gases entrained are previously burnt gases, and thus minimize the conditions for secondary ignition. With the disclosed suppressor 100B, the slip streams 42A and 42B will mix with gases 40 exiting the main exit 38 and the mixture will not combust due to insufficient oxygen.

The slip streams 42A and 42B also create destructive interference with the sound emitted as the gases 40 exits the main exit 38. This is achieved by controlling the timing the slip steams 42A and 42B exit the vents 56C. As described above, the number of vents 56C, 58 (size and shape) may be set based on performance, and the pitch of the ribs 18A, 78A and 86 may be set to control the timing that the slip stream 42A and 42B exits the vents 56C. The pitch and venting configuration is also set based on the type of firearm 150 and projectile.

Moreover, the chambers 60B, 62A, 64 and 66B reduce the formation of mach disc as the gases 40 exit the main exit 38. This is because the speed (pressure) is reduced. This also reduces a potential for secondary ignition or a flash.

In accordance with aspects of the disclosure, the suppressors 100, 100A and 100B (i) reduces the amount of heat absorb by the suppressors, (ii) reduces the backpressure of the suppressors, (iii) reduces the acoustic pop emitted from gases exiting the suppressors; and (iv) reduces a risk of a secondary ignition and flash.

The terminology used herein is for the purpose of describing particular aspects only and is not intended to be limiting the scope of the disclosure and is not intended to be exhaustive. Many modifications and variations will be apparent to those of ordinary skill in the art without departing from the scope and spirit of the disclosure.

What is claimed is:

1. An apparatus comprising:

a proximal end wall on a proximal end, the proximal end wall having with a first central opening configured to receive a firearm, a distal end wall on a distal end, the distal end wall having a main exit to receive a projectile from the firearm and gases expelled by the firearm;

a cylindrical outer wall extending between the proximal end and the distal end, where there is an annular gap between the proximal end wall and the cylindrical outer wall, the cylindrical outer wall having an inner surface and an outer surface, a non-linear wall extending from the inner surface of the cylindrical outer wall, the non-linear wall being positioned at a predetermined distance from the proximal end, the non-linear wall having second central opening aligned with the first central opening, the second central opening configured to receive the projectile from the firearm and gases expelled by the firearm, the cylindrical outer wall having first plurality of air transfer ports adjacent to the non-linear wall and between the non-linear wall and the proximal end, each air transfer port of the first plurality of air transfer ports being an opening in the cylindrical outer wall, the non-linear wall being configured and dimensioned to divert the gases toward the first plurality of air transfer ports;

a can being disposed around and spaced apart from the cylindrical outer wall, the can having an inner surface;

a barrier rib extending annularly from the outer surface of the cylindrical outer wall to the can, the barrier rib configured to block a portion of the gases expelled from the firearm from flowing toward the distal end as the projectile moves from the proximal end to the distal end; and a first plurality of ribs extending from the outer surface of the cylindrical outer wall to the can, the first plurality of ribs extending between the annular gap and the barrier rib, where a respective space between adjacent ribs defines respective channels for gases expelled from the firearm to flow, each channel is in fluid communication with one of the first plurality of air transfer ports, such that gases expelled from the firearm flows into the each transfer port and each channel, respectively, as the projectile moves from the proximal end to the distal end, where the first plurality of ribs extend non-linearly.

2. The apparatus of claim 1, further comprising:

an inner wall extending from the proximal end wall, the inner wall having a first portion and a second portion, the first portion being configured to extend along a length of an inserted portion of a muzzle of the firearm and the second portion configured to be a stop for the muzzle, the first portion being spaced from the inner surface of the cylindrical outer wall, wherein the proximal end wall has a non-linear inner surface, the non-linear inner surface is configured to divert gases flows from the channels formed by the adjacent ribs and flowing though the annular gap into the space between the inner surface of the cylindrical outer wall and the first portion and the second portion of the inner wall; and an angled projection extending between the second portion and the inner surface of the cylindrical outer wall, the angled projection is a barrier for gases in the space between the inner surface of the cylindrical outer wall and the first portion and the second portion, and is configured to prevent gases from flowing further toward the distal end, the angled projection further configured to allow the gases expelled from the firearm to expand and be directed to the first plurality of air transfer ports.

3. The apparatus of claim 2, further comprising:

another rib extending annularly from the outer surface of the cylindrical outer wall to the can, the another rib being a predetermined distance from the distal end, a second plurality of ribs extending from the outer surface of the cylindrical outer wall to the can, the second plurality of ribs extending between the barrier rib and the another rib, where a respective space between adjacent ribs of the second plurality of ribs defines respective channels for gases expelled from the firearm to flow, a second plurality of air transfer ports adjacent to the non-linear wall and between the non-linear wall and the distal end, where a number of the second plurality of air transfer ports is less than a number of the first plurality of air transfer ports, each air transfer port of the second plurality of air transfer ports being an opening in the cylindrical outer wall, wherein a subset of channels formed by the adjacent ribs of the second plurality of ribs are respectively aligned with a corresponding one of the second plurality of air transfer ports, respectively, such that gases expelled from the firearm as the projectile moves from the proximal end to the distal end flow into the second plurality of air transfer ports and the subset of channels, respectively, the apparatus further comprising another non-linear wall extending from the inner surface of the cylindrical outer wall, the another non-linear wall having a corresponding central opening to the second central opening and aligned therewith, the another non-linear wall being positioned between the second plurality of air transfer ports and the distal end, the non-linear wall and the another non-linear wall sandwiching the second plurality of air transfer ports, the another non-linear wall being configured and dimensioned to divert the gases toward the second plurality of air transfer ports.

4. The apparatus of claim 3, wherein the main exit is at least partially aligned with the first central opening and the second central opening, the distal end wall having a diameter equal to a diameter of the can such that there is a space between the another rib and the distal end wall in a longitudinal directional, the space also extending between the outer surface of the cylindrical outer wall and the inner surface of the can, wherein the another rib has a plurality of vents configured to allow gases flowing in the subset of channels formed by the adjacent ribs of the second plurality of ribs to enter the space defined between the another rib and the distal end wall in the longitudinal directional and extending between the outer surface of the cylindrical outer wall and the inner surface of the can, wherein the plurality of vents is configured to allows gases within the space between the another rib and the distal end wall in the longitudinal directional and extending between the outer surface of the cylindrical outer wall and the inner surface of the can to enter other channels formed by the adjacent ribs of the second plurality of ribs, and wherein the barrier rib is configured to block gases expelled from the firearm that are in the other channels from flowing further toward the proximal end as the projectile moves from the proximal end to the distal end.

5. The apparatus of claim 4, wherein the distal end wall has a plurality of vents configured allow gases within the space defined between the another rib and the distal end wall in the longitudinal directional and extending between the outer surface of the cylindrical outer wall and the inner surface of the can to escape the apparatus.

6. The apparatus of claim 5, wherein a timing that gases escape the apparatus from the plurality of vents in the distal end wall is controllable to cause destructive interference with a sound generated by gases escaping the apparatus from the main exit.

7. The apparatus of claim 6, wherein the first plurality of ribs and the second plurality of ribs extend between the proximal end and the distal end in a spiral pattern, the first plurality of ribs have a first pitch and the second plurality of ribs have a second pitch, the first pitch and second pitch being set to control the timing.

8. The apparatus of claim 6, wherein a size of the plurality of vents in the another rib is set to control the timing.

9. The apparatus of claim 5, further comprising:

a plurality of baffles disposed between the another non-linear wall and the distal end wall, each of the baffles having a third central opening, which is aligned with the first central opening, the second central opening and at least partially aligned with the main exit, each baffle configured to divert gases expelled by the firearm as the projectile moves from the proximal end to the distal end toward the inner surface of the cylindrical outer wall, the baffle closest to the distal end wall having at least one slit configured to allow gases to flow into a pocket.

10. The apparatus of claim 5, wherein the gases which escape the apparatus via the plurality of vents in the distal end wall generate a slip stream, the slip stream restricting a generation of a mushroom of gases created by the gases escaping the apparatus from the main exit.

11. The apparatus of claim 9, wherein the gases that are diverted into the plurality of channels throughout the apparatus, into the space, toward the inner surface of the cylindrical outer wall and into the pocket, change a speed that gases escaping the apparatus from the main exit travels from a speed in which the gases enter the apparatus.

12. An apparatus comprising:

a proximal end wall on a proximal end having a first central opening configured to receive a firearm, a distal end wall on a distal end having a main exit to receive a projectile from the firearm and gases expelled by the firearm an outer wall extending between the proximal end and the distal end, the outer wall having a first portion, a second portion and a third portion, the first portion extending from an inner surface of the proximal end wall to a first preset position in a longitudinal direction, the second portion extending between a second preset position and the distal end in the longitudinal direction, and the third portion connecting the first portion and the second portion, a non-linear wall extending from an inner surface of the second portion of the outer wall, the non-linear wall having second central opening aligned with the first central opening, the second central opening configured to receive a projectile from the firearm and gases expelled by the firearm;

a can being disposed around and spaced apart from the outer wall, the can having an inner surface, a distance between the inner surface of the can and an outer surface of the second portion is smaller than a distance between the inner surface of the can and an outer surface of the first portion;

a segmented barrier rib having a plurality of segments, the segmented barrier rib extending from the outer surface of the second portion of the outer wall to the can, each segment extending in a circumferential direction, where there is a gap between adjacent segments in the circumferential direction;

a first plurality of ribs extending between the outer surface of the first portion and the inner surface of the can and extending between the outer surface of the third portion and the inner surface of the can and extending from the segmented barrier rib toward the proximal end, each segment having a first end and a second end in the circumferential direction, wherein one of the first plurality of ribs extends from the first end and another of the first plurality of ribs extends from the second end, wherein there is a gap between the first plurality of ribs and the proximal end wall, the third portion having a plurality of air transfer ports, each air transfer port extending between the first portion and the second portion, where the third portion extends between adjacent air transfer ports, and where an air transfer port corresponds to a segment such that the air transfer port is between the one of the first plurality of ribs which extends from the first end and the another of the first plurality of ribs which extends from the second end of the same segment, where a respective space between the one of the first plurality of ribs which extends from the first end and the another of the first plurality of ribs which extends from the second end of the same segment defines respective channels for gases expelled from the firearm to flow, each channel is in fluid communication with one of the plurality of air transfer ports, such that gases expelled from the firearm flows into the each transfer port and each channel, respectively, the non-linear wall being configured and dimensioned to divert the gases toward the plurality of air transfer ports, each segment is configured to block a portion of gases expelled from the firearm from flowing toward the distal end as the projectile moves from the proximal end to the distal end, wherein the inner surface of the proximal end wall is non-linear, the non-linear inner surface is configured to divert gases flowing from the channels and into the gap between the first plurality of ribs and the proximal end wall into other channels such that gases expelled from the firearm flow toward the distal end, each of the other channels is defined by one of the plurality of ribs which extends from a first end of a segment and another of the plurality of ribs which extends from a second end of an adjacent segment, and wherein the first plurality of ribs extend non-linearly.

13. The apparatus of claim 12, further comprising a rib extending annularly from the outer surface of the second portion to the can, the rib being a predetermined distance from the distal end; and a second plurality of ribs extending from the outer surface of the second portion wall to the can, the second plurality of ribs extending from the rib toward the proximal end, where a respective space between adjacent ribs of the second plurality of ribs defines respective channels for gases expelled from the firearm to flow, wherein the second plurality of ribs extend non-linearly, the other channels being in fluid communication with the channels defined by the adjacent ribs of the second plurality of ribs.

14. The apparatus of claim 13, wherein a number of the second plurality of ribs is less than a number of the first plurality of ribs.

15. The apparatus of claim 13, wherein the second plurality of ribs extends to a respective segment.

16. The apparatus of claim 13, wherein the main exit is at least partially aligned with the first central opening and the second central opening, and wherein the distal end wall has a diameter equal to a diameter of the can such that there is a space between the rib and the distal end wall in the longitudinal directional, the space also extending between the outer surface of the second portion and the inner surface of the can, the rib has a plurality of vents configured to allow gas flowing in the channels formed by the adjacent ribs of the second plurality of ribs to enter the space.

17. The apparatus of claim 16, wherein the distal end wall has a first plurality of vents configured allow gases within the space to escape the apparatus.

18. The apparatus of claim 17, wherein a timing that gases escape the apparatus from the first plurality of vents in the distal end wall is controllable to cause destructive interference with a sound generated by gases escaping the apparatus from the main exit.

19. The apparatus of claim 18, wherein the first plurality of ribs and the second plurality of ribs extend in a spiral pattern, the first plurality of ribs have a first pitch and the second plurality of ribs have a second pitch, the first pitch and second pitch being set to control the timing.

20. The apparatus of claim 18, wherein a size of the plurality of vents in the rib is set to control the timing.

21. The apparatus of claim 17, further comprises:

a plurality of baffles disposed between the non-linear wall and the distal end wall, each of the baffles having a third central opening, which is aligned with the first central opening, the second central opening and at least partially aligned with the main exit, each baffle is configured to divert gases expelled by the firearm as the projectile moves from the proximal end to the distal end toward the inner surface of the second portion, at least the baffle closest to the distal end wall has at least one slit configured to allow gases to flow toward the distal end.

22. The apparatus of claim 21, wherein each of the plurality of baffles has at least one slit configured to allow gases to flow toward the distal end.

23. The apparatus of claim 22, wherein the distal end wall further has a second plurality of vents configured allow gases flowing through the slit in each of the plurality of baffles to escape the apparatus, the second plurality of vents is between the first plurality of vents and the main exit in the radial direction.

24. The apparatus of claim 23, wherein a timing that gases escape the apparatus from the second plurality of vents in the distal end wall is controllable to cause destructive interference with a sound generated by gases escaping the apparatus from the main exit.

25. The apparatus of claim 24, wherein a number and size of each slit is set to control the timing.

26. The apparatus of claim 24, wherein the gases which escape the apparatus via the first plurality of vents and the second plurality of vents in the distal end wall generate slip streams, the slip streams restricting a generation of a mushroom of gases created by the gases escaping the apparatus from the main exit.

27. The apparatus of claim 17, further comprises:

an inner annular wall spaced apart from second portion, the inner annular wall extending from the distal end wall toward the proximal end;

a third plurality of ribs extending from an outer surface of the inner annular wall to an inner surface of the second portion, the third plurality of ribs extending from the distal end wall toward the proximal end, where a respective space between adjacent ribs of the third plurality of ribs defines respective channels for gases expelled from the firearm to flow, wherein the third plurality of ribs extend non-linearly.

28. The apparatus of claim 27, further comprises:

a plurality of baffles disposed between the non-linear wall and the distal end wall, each of the baffles having a third central opening, which is aligned with the first central opening, the second central opening and at least partially aligned with the main exit, each baffle extending from an inner surface of the inner annular wall, each baffle is configured to divert gases expelled by the firearm as the projectile moves from the proximal end to the distal end toward the inner surface of the inner annular wall, at least the baffle closest to the distal end wall has at least one slit configured to allow gases to flow toward the distal end and another wall, the another wall is disposed between the non-linear wall and the baffles, the another wall is configured to divert gases to flow toward the channels defined by the adjacent ribs of the third plurality of ribs.

29. The apparatus of claim 28, wherein the distal end wall further has a second plurality of vents configured allow gases from channels defined by the adjacent ribs of the third plurality of ribs to escape the apparatus, the second plurality of vents is between the first plurality of vents and the main exit in the radial direction.

30. The apparatus of claim 29, wherein a timing that gases escape the apparatus from the second plurality of vents in the distal end wall is controllable to cause destructive interference with a sound generated by gases escaping the apparatus from the main exit.

31. The apparatus of claim 29, wherein the gases which escape the apparatus via the first plurality of vents and the second plurality of vents in the distal end wall generate slip streams, the slip streams restricting a generation of a mushroom of gases created by the gases escaping the apparatus from the main exit.

32. The apparatus of claim 29, wherein each of the plurality of baffles has at least one slit configured to allow gases to flow toward the distal end.

33. The apparatus of claim 32, wherein the distal end wall further has a third plurality of vents configured allow gases diverted by the baffles to escape the apparatus.

* * * * *